US005992516A

United States Patent [19]

Palynchuk et al.

[11] Patent Number: 5,992,516

[45] Date of Patent: Nov. 30, 1999

[54] WELL STRING INJECTOR

[75] Inventors: Alexander Palynchuk, St. Alberta, Canada; Alan Palynchuk; Mark Palynchuk, both of St. Albert, Canada

[73] Assignee: 707746 Alberta Ltd., Alberta, Canada

[21] Appl. No.: 08/889,571

[22] Filed: Jul. 8, 1997

[51] Int. Cl.[6] ..... E21B 19/08; E21B 19/22

[52] U.S. Cl. ..... 166/77.2; 166/77.4

[58] Field of Search ..... 166/77.4, 77.2; 254/29 R; 175/423; 188/67

[56] References Cited

U.S. PATENT DOCUMENTS

| | | | |
|---|---|---|---|
| Re. 25,680 | 11/1964 | Brown | 254/29 R |
| 1,837,990 | 12/1931 | Otis | 254/29 R |
| 1,895,132 | 1/1933 | Minor | 166/77.4 |
| 3,191,450 | 6/1965 | Wilson | 74/219 |
| 3,191,981 | 6/1965 | Osmun | 294/86.31 |
| 3,215,203 | 11/1965 | Sizer | 166/77 |
| 3,216,731 | 11/1965 | Dollison | 277/1 |
| 3,285,485 | 11/1966 | Slator | 226/172 |
| 3,313,346 | 4/1967 | Cross | 166/5 |
| 3,559,905 | 2/1971 | Palynchuk | 242/54 |
| 3,677,345 | 7/1972 | Sizer | 126/315 |
| 3,690,136 | 9/1972 | Slator et al. | 72/160 |
| 3,754,474 | 8/1973 | Palynchuk | 74/162 |
| 3,865,408 | 2/1975 | Young | 285/3 |
| 3,926,260 | 12/1975 | Slator | 166/315 |
| 4,085,796 | 4/1978 | Council | 166/77.5 |
| 4,251,176 | 2/1981 | Sizer et al. | 414/22 |
| 4,475,607 | 10/1984 | Haney | 175/423 |
| 4,673,035 | 6/1987 | Gipson | 166/77 |
| 4,705,107 | 11/1987 | Council et al. | 166/170 |
| 4,715,456 | 12/1987 | Poe, Jr. et al. | 175/423 |
| 5,094,340 | 3/1992 | Avakov | 198/626.1 |
| 5,133,405 | 7/1992 | Elliston | 166/77 |
| 5,188,174 | 2/1993 | Anderson, Jr. | 166/77 |
| 5,309,990 | 5/1994 | Lance | 166/77 |
| 5,553,668 | 9/1996 | Council et al. | 166/77.3 |

FOREIGN PATENT DOCUMENTS

| | | |
|---|---|---|
| 953644 | 8/1974 | Canada . |
| 1096850 | 3/1981 | Canada . |
| 1178533 | 11/1984 | Canada . |
| 1220418 | 4/1987 | Canada . |
| 1265998 | 2/1990 | Canada . |

OTHER PUBLICATIONS

Abstract of U.S. Patent No. 5,547,314, issued Aug. 20, 1996, Ames; Thomas J., Offshore system and method for storing and tripping a continuous length of jointed tubular conduit, 2 pages.

Information on prior public use of gripper block shown in Fig. 21A.

*Primary Examiner*—Hoang C. Dang

*Attorney, Agent, or Firm*—Anthony R. Lambert

[57] ABSTRACT

A well string injector has a frame, with a guide at one end for guiding well string along the frame and a support at the other end for directing the well string towards a target. At least one of a pair of longitudinally spaced clamps is movable with respect to the other and at least one clamp is oriented on the frame to provide clamping forces on well string by relative movement between clamping members, each carrying a well string gripping die, predominantly in a transverse direction perpendicular to the frame longitudinal direction. A third well string gripping die may be carried by the clamp for location between parallel spaced well string clamped by the clamp. A well string gripping die is provided that includes a gripping surface that induces an optimized stress distribution in well string clamped by the gripping die when the well string is in tension. A well string gripping die is provided that includes one and preferably a pair of barrier walls for preventing walk out of well string.

30 Claims, 27 Drawing Sheets

WELL STRING INJECTOR

FIELD OF THE INVENTION

This invention relates to apparatus and methods for injecting coilable product such as coiled tubing and coiled rods into wells.

BACKGROUND OF THE INVENTION

Various methods have been described for injecting coilable product, or well string, into a well. One early such design is shown in U.S. Pat. No. 3,559,905 of Palynchuk, issued Feb. 1, 1971, in which a continuous chain with gripping blocks carried by the chain is used to inject the well string into the well. More recently, such continuous chain gripper systems have been described in U.S. Pat. No. 5,553,668 of Council, et al, issued Sep. 10, 1996.

These continuous chain gripper systems have many moving parts which may wear, are complicated and are not readily adaptable to inject parallel well strings. A stepping system has been proposed by Sizer, Canadian patent no. 1,220,418 issued Apr. 14, 1987, but this device used slips to grip the well string, which tend to damage the well string due to the use of teeth and the relatively uncontrollable gripping force exerted by the slips.

Gripper blocks have been used with continuous chain gripper systems that do not damage well string. Gripper blocks have also been used that have optimized stress distribution. Distribution due to the use of plural grooves in the face of the gripping dies, in which successive grooves deepen in the direction of tension.

The inventor has proposed a well string injector in which the gripping advantages of the continuous chain gripper systems are combined with the simplicity and fewer moving parts of the stepper systems.

SUMMARY OF THE INVENTION

There is therefore provided in accordance with a first aspect of the invention, a well string injector, comprising a frame, with a guide at one end for guiding well string along the frame and a support at the other end for directing the well string towards a target. At least one of a pair of longitudinally spaced clamps is movable with respect to the other and at least one clamp is oriented on the frame to provide clamping forces on well string by relative movement between clamping members predominantly in a transverse direction perpendicular to the frame longitudinal direction.

In further aspects of the invention, the clamping members carry gripping dies, a first one of the clamping members is adjustable secured to the frame and the other of the clamping members is adjustably secured to the first one of the clamping members. The clamping members may be formed of a cylinder and piston combination, the cylinder having an open and closed end, with a first gripping die on the closed end of the cylinder, arms extending from the piston on both sides of the cylinder, beyond the first gripping die, and a second gripping die mounted between the ends of the arms in a position opposed to the first gripping die.

In a further aspect of the invention, the clamping members may be pivotally mounted with respect to each other for movement about a pivot; and a force applicator may be attached at respective first and second points of attachment to each of the clamping members for applying force to the clamping members.

In a further aspect of the invention, the pivot is between the first and second well string gripping dies and the respective points of attachment of the force applicator to the clamping members.

In a further aspect of the invention, a third well string gripping die may be carried by the clamp for location between parallel spaced well string clamped by the clamp.

In a further aspect of the invention, a well string gripping die is provided, particularly in combination with the clamps described, that includes a gripping surface that induces an optimized stress distribution in well string clamped by the gripping die when the well string is in tension.

In a further aspect of the invention, a well string gripping die is provided, particularly in combination with the clamps described, that includes one and preferably a pair of barrier walls for preventing walk out of well string.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
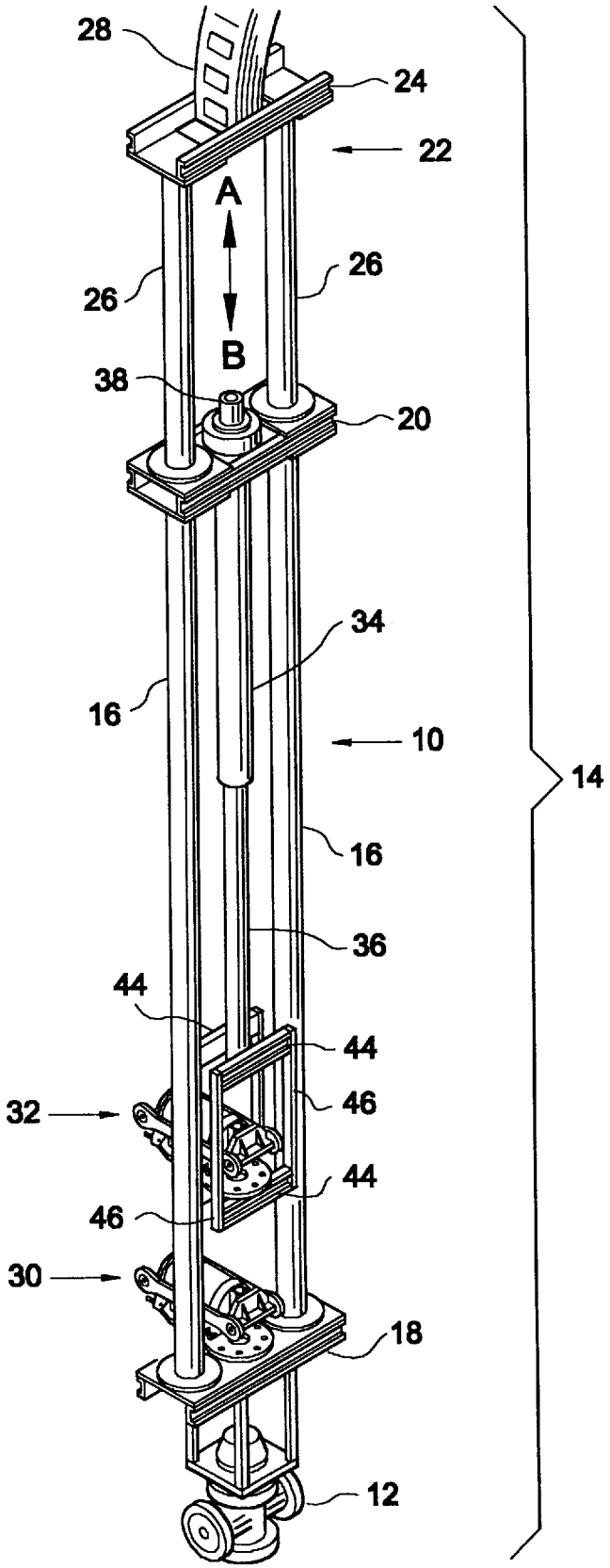
FIG. 1 is a perspective view of a well string injector according to the invention, using a double hollow rod cylinder for moving upper and lower well string gripping clamps on the frame with respect to each other.
Figure 2:
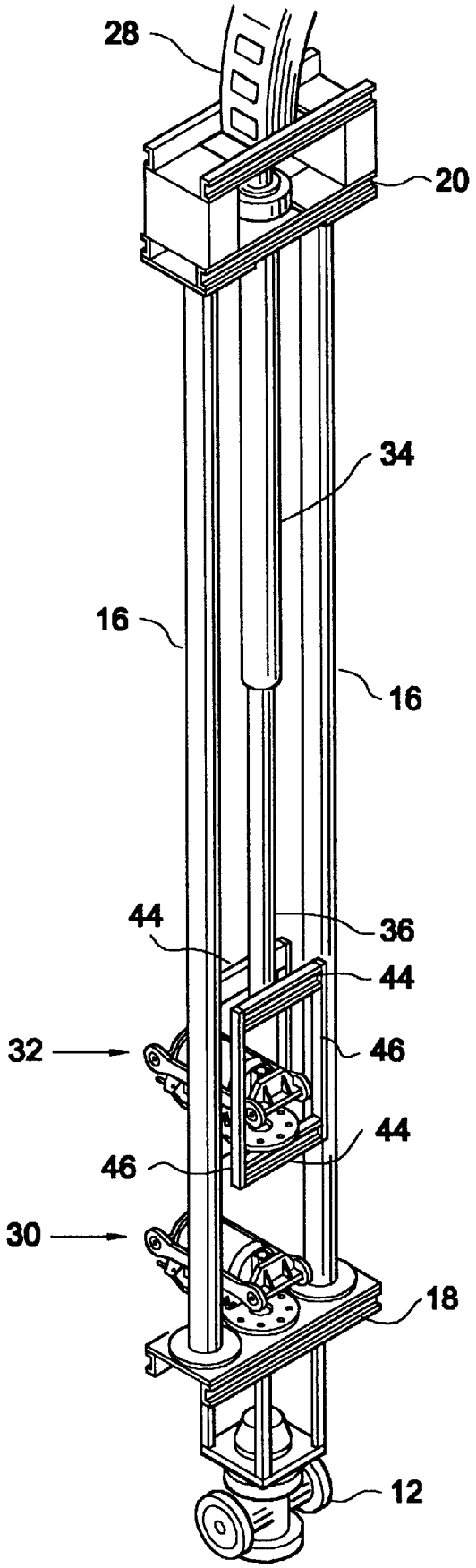
FIG. 2 is a perspective view of a well string injector according to the invention, using a single hollow rod cylinder for moving upper and lower well string gripping clamps on the frame with respect to each other.

Referring to FIGS. 1, 2, 3 and 4, there are shown several embodiments of a well string injector 10 mounted in position over a wellhead 12 of a well. In FIG. 1, the well string injector 10 is formed of a frame 14 secured to the wellhead 12 as by bolting. The frame 14 is formed of a pair of tubular members 16 bolted between lower and upper beams 18, 20 respectively at opposed frame ends of the frame 14. Lower beam 18 is secured to the wellhead 12. Upper beam 20 supports a guide structure 22 that is formed of a beam 24 secured to the upper beam 20 by tubular members 26. Secured to the central part of the beam 24 is a coilable product guide 28 of conventional construction. Guide 28 may be one piece or foldable. A lower clamp 30 is secured to the lower beam 18 as by bolting. An upper clamp 32, normally similar to clamp 30, is mounted on the frame 14 by double acting cylinder 34 with lower rod 36 and upper rod 38. The cylinder 34 is mounted along a longitudinal axis AB of frame 14, such that the upper clamp 32 is movable longitudinally along the frame 14. Rods 36 and 38 are hollow for receiving a well string, such as well tubing or rod, which may be continuous or jointed. Cylinder 34 has an annular piston for actuating the rods 36 and 38. As shown in FIG. 2, the upper rod 38 and the beam 24 may be omitted and the coilable product guide 28 connected directly to the upper beam 20. The rods 36 and 38 may thus be moved by the actuation of the cylinder 34 upwards and downwards as indicated by the double arrow AB.

Figure 1A:
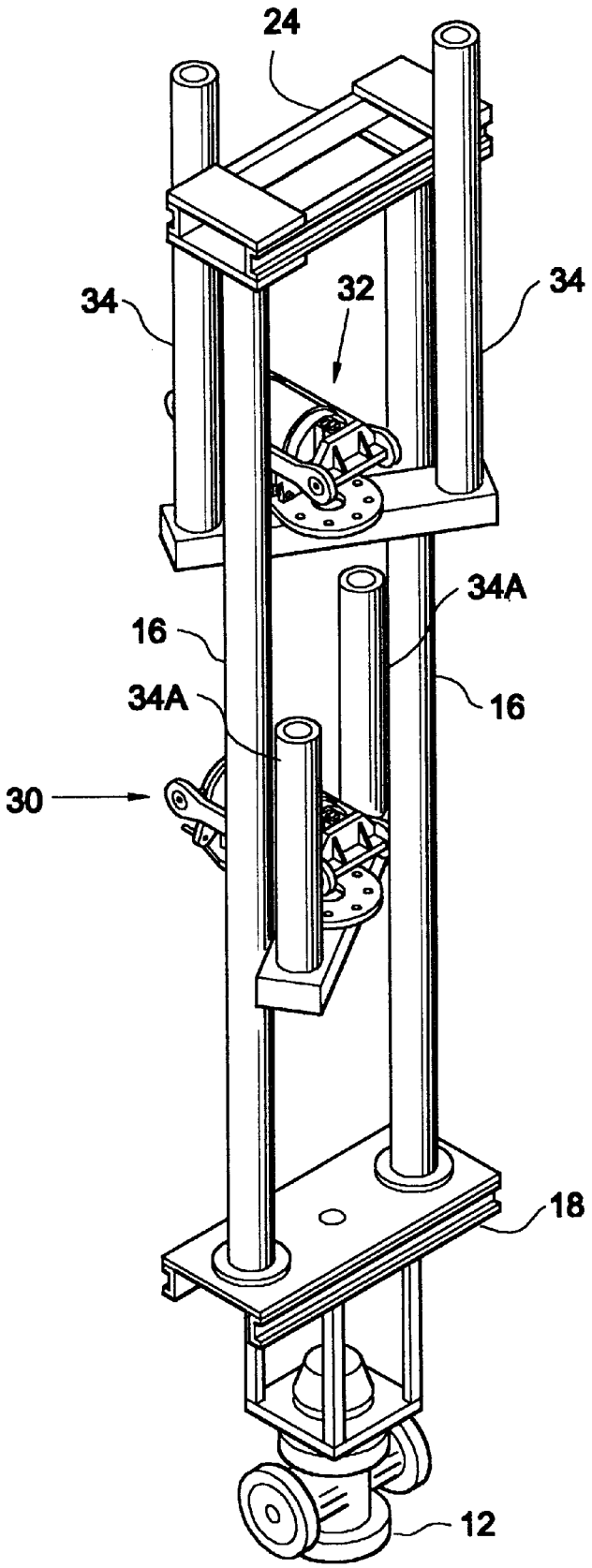
FIG. 1A is a perspective view of a well string injector according to the invention, using two pairs of double cylinders for moving upper and lower well string gripping clamps on the frame with respect to each other.
Figure 3:
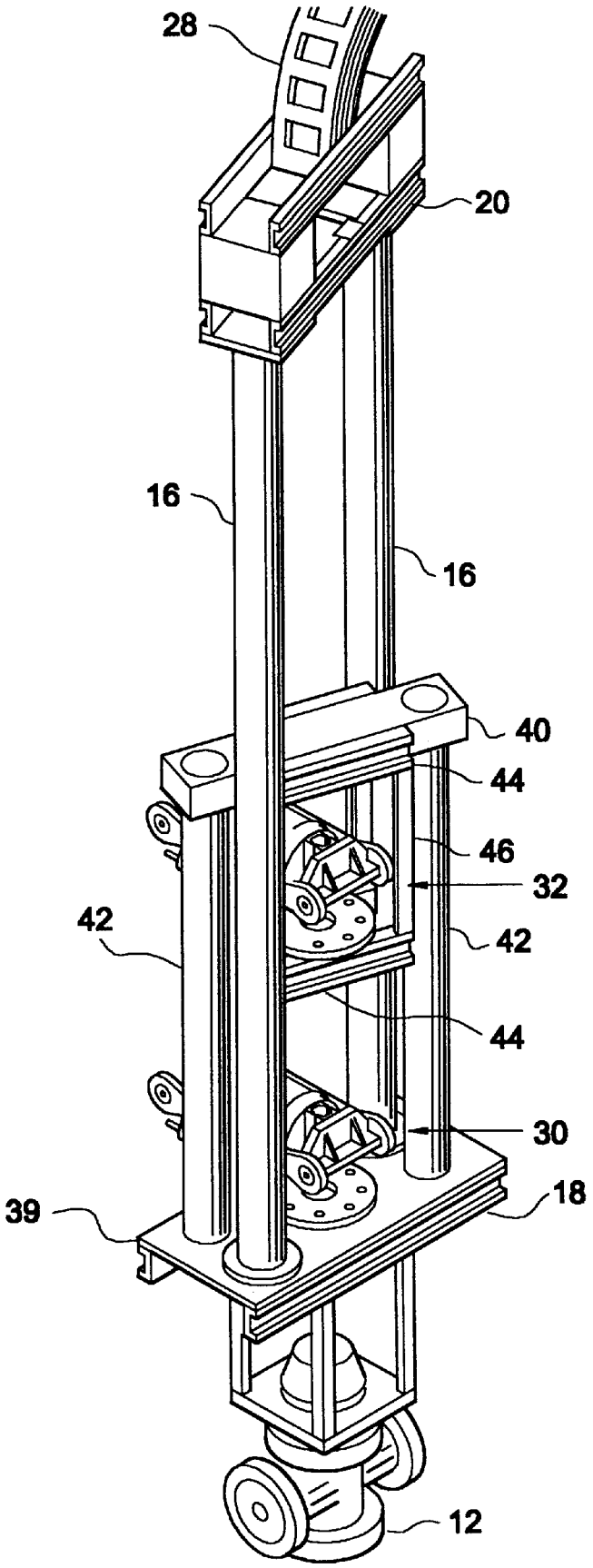
FIG. 3 is a perspective view of a well string injector according to the invention, using a double cylinder for moving upper and lower well string gripping clamps on the frame with respect to each other.

To obtain maximum speed of penetration and pulling out of well string in a well, it is preferred to have both clamps 30 and 32 mounted on hydraulic cylinders as shown in FIG. 1A. In this instance, clamp 30 is mounted for longitudinal movement on cylinders 34A, and clamp 32 is mounted for longitudinal movement on cylinders 34. Otherwise, the well string injector of FIG. 1A is constructed in the same manner as the well string injector of FIG. 1. In FIGS. 1, 2 and 3, one of the clamps is shown as being fixed. In the alternative embodiment of FIG. 1A, both clamps are movable with respect to the frame. When both clamps are movable, the speed of the arrangement may be doubled.

A further embodiment of a mechanism used to move the clamps 30 and 32 longitudinally on the frame 14 with respect to each other is shown in FIG. 2. In this instance, the frame 14 has the same constructions as in FIG. 1, except that only one rod 36 is used in double acting cylinder 34. Hence, guide 28 may be connected directly to the beam 20 over the end of the cylinder 34. The guide 28 along with the beam 20 in FIG. 2, and beam 24 in FIG. 1, guide well string along the frame 14 from the upper frame end towards the lower frame end.

A further embodiment of a mechanism used to move the clamps 30 and 32 longitudinally on the frame 14 is shown in FIG. 3. In this instance, the tubular members 16 are placed at diagonally opposed corners of the upper plate 39 of lower beam 18, and the upper clamp 32 is mounted on an intermediate beam 40, which is movable longitudinally on the frame by double acting cylinders 42 mounted on the lower beam 18.

The upper clamps 32 shown in FIGS. 1, 2 and 3 are secured to the rod 36 (FIGS. 1, 2) and the beam 40 (FIG. 3) in a clamp sub-frame 44 consisting of spaced parallel upper and lower pairs of I-beams secured to each other by flat bars 46.

Figure 4:
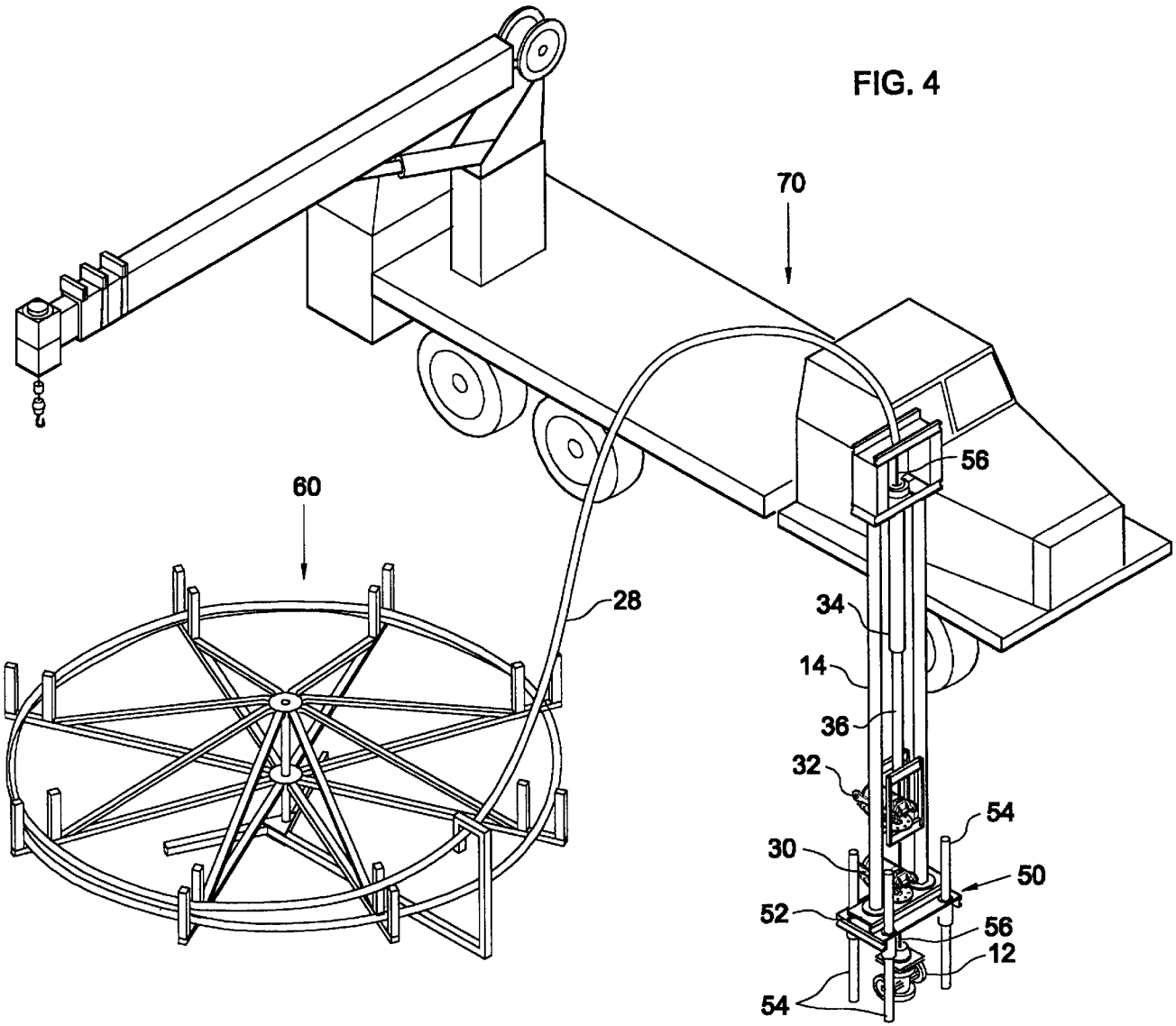
FIG. 4 is a perspective view of a well string injector according to the invention with associated storage and transportation apparatus, the storage apparatus being shown in operational position.
Figure 5:
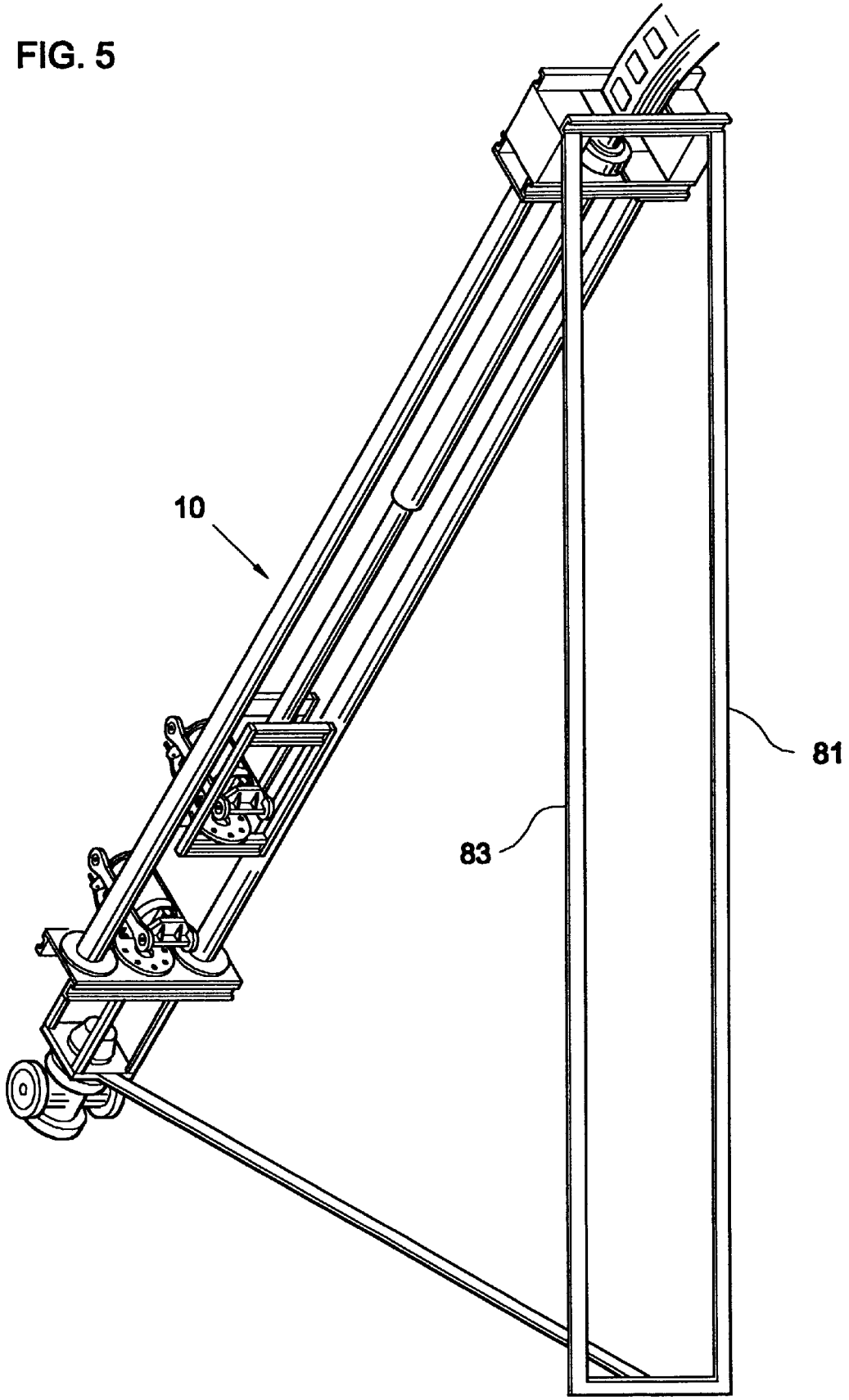
FIG. 5 is a perspective view of a well string injector according to the invention with a frame mounted for servicing slanted wells.
Figure 6:
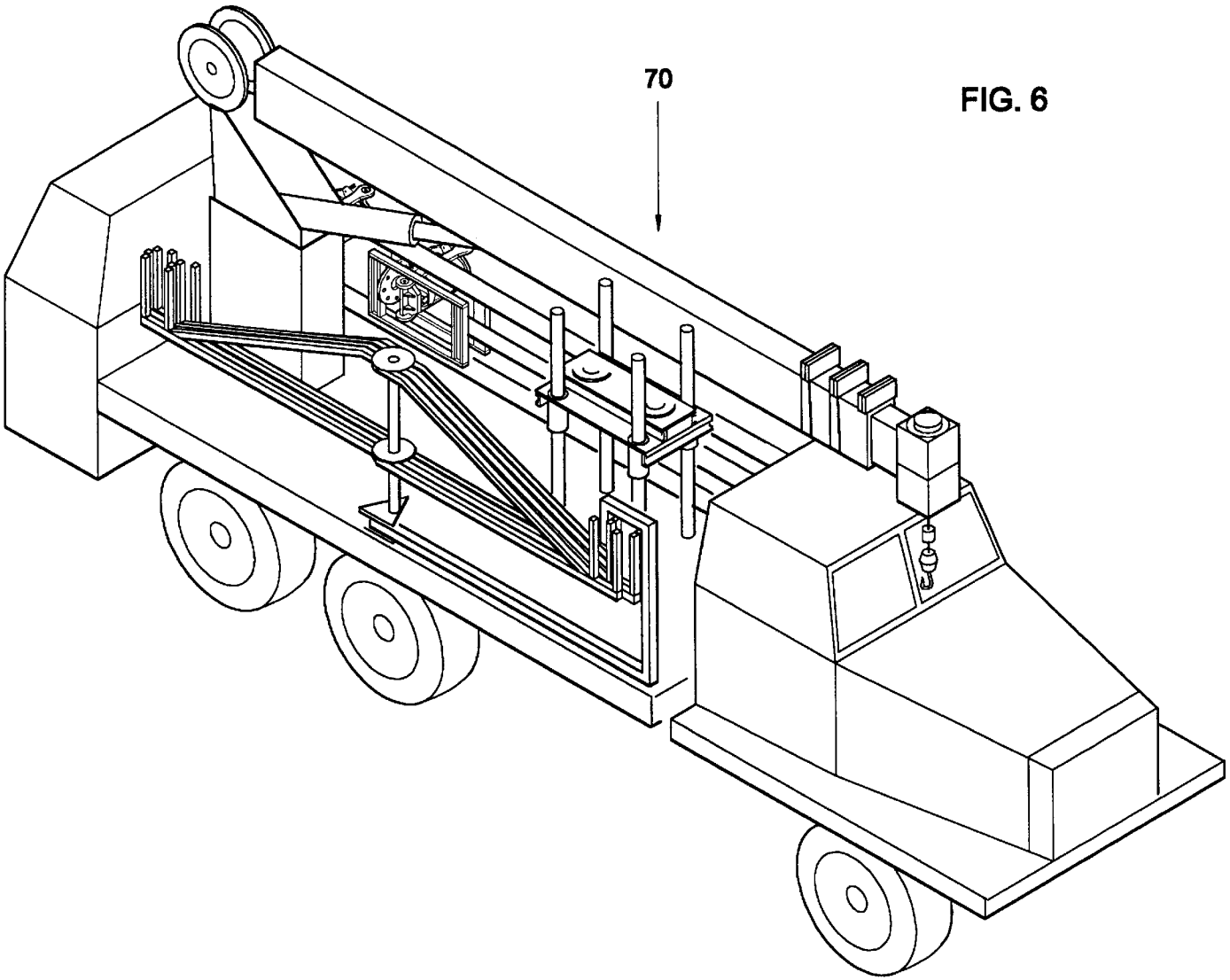
FIG. 6 is a perspective view of a well string injector according to the invention including storage reel mounted on transportation apparatus.

Referring to FIG. 4, the well string injector of FIGS. 1–3 may be located over a well 12, or other target, using a height adjustable platform 50 formed of base 52 and ground engaging supports 54. Well string 56, such as coilable product, is guided through guide 28 to the well string injector. A storage mechanism for the well string 56 is provided by rack or carousel 60. Both the well string injector 10 and carousel 60 may be transported on truck 70, as shown in FIG. 6. Where a well is slanted, the well string injector 10 may be supported at an angle anywhere from 0° to 90° by frame members 81 and 83 shown in FIG. 5.

Figure 7A:
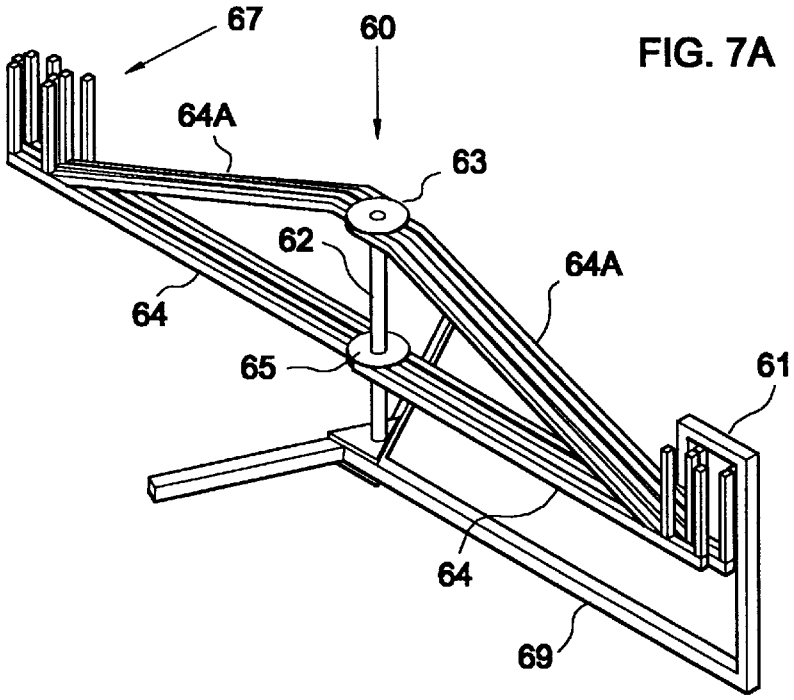
FIGS. 7A–7C are perspective views showing a storage reel in closed (FIG. 7A), intermediate (FIG. 7B) and open positions (FIG. 7C)
Figure 7B:
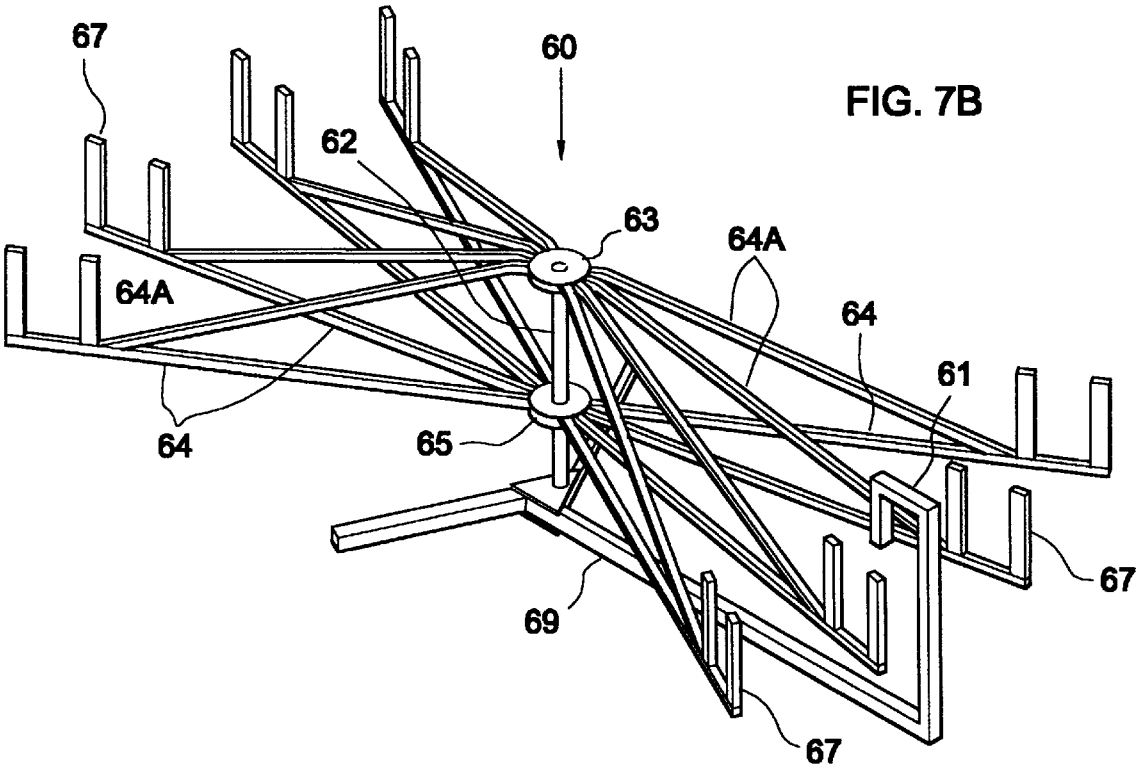
Figure 7C:
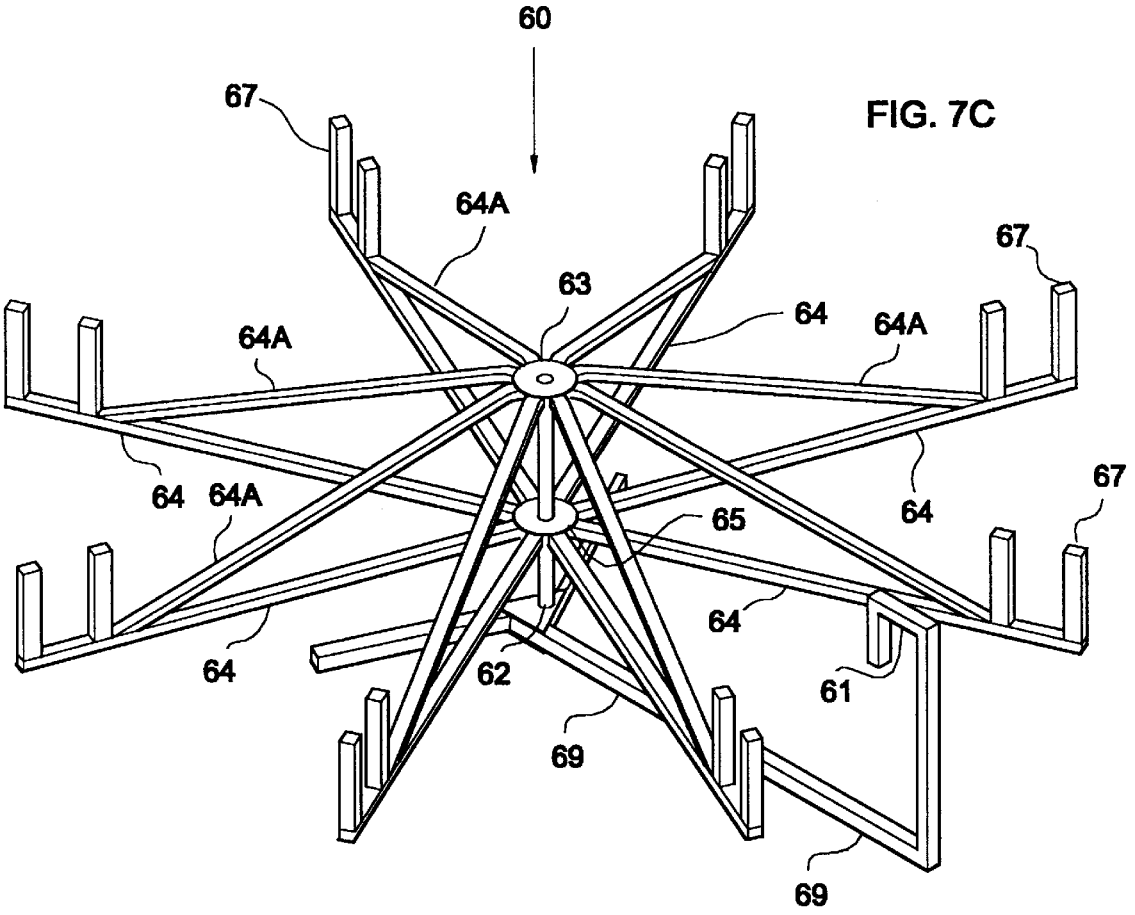
Figure 7D:
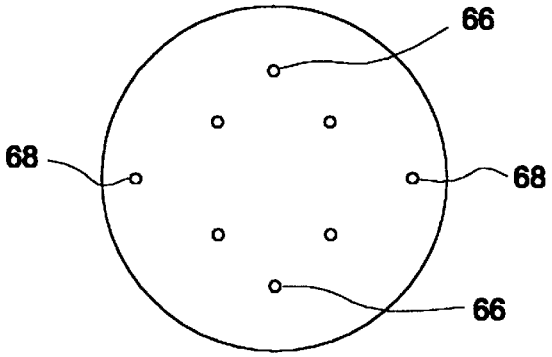
FIG. 7D is a top view of the central pivot and arm restraint for the storage reel of FIGS. 7A–7C.
Figure 8:
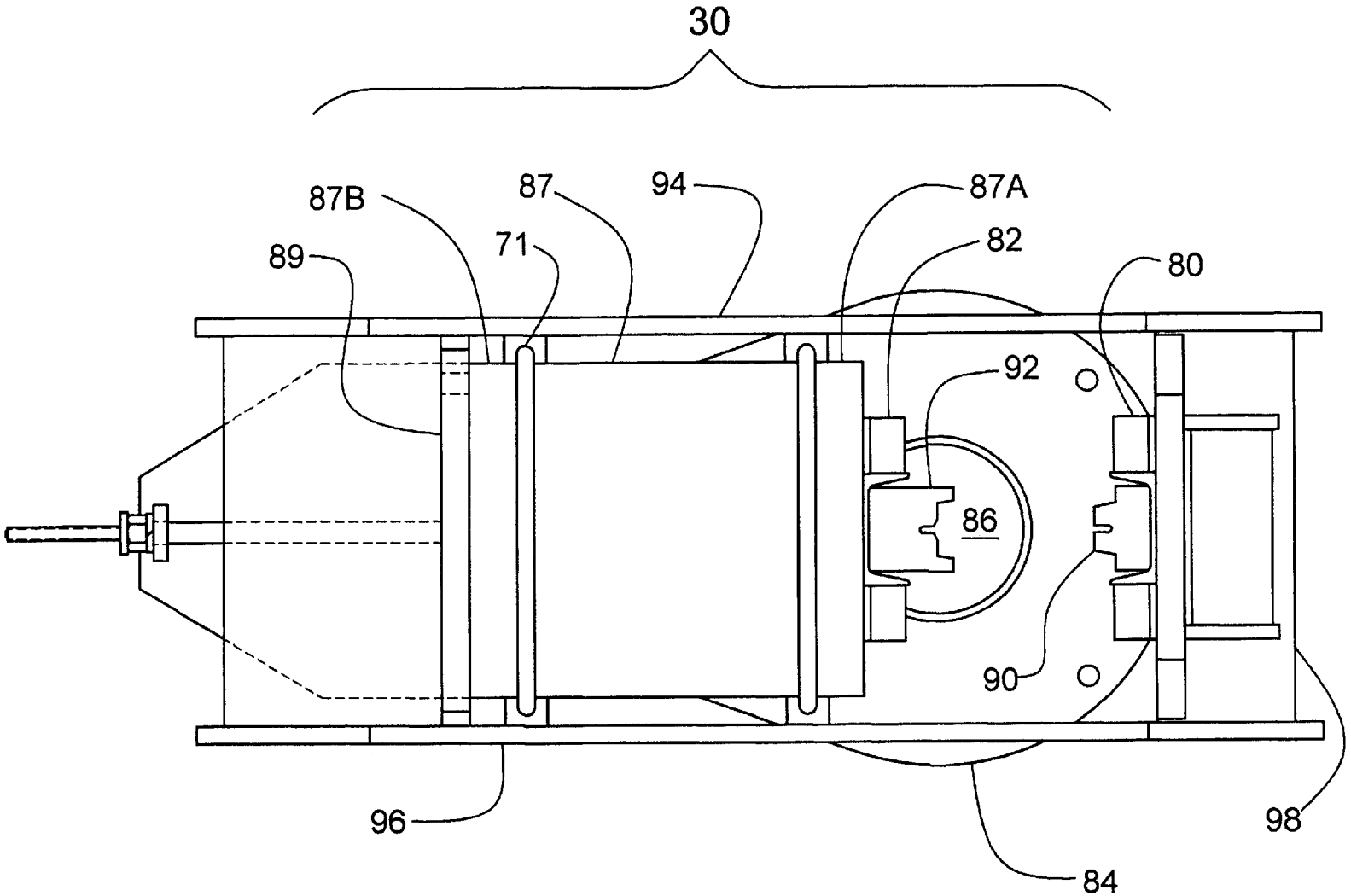
FIG. 8 is a plan view of a clamp, in open position, for use with a well string injector according to the invention.
Figure 9:
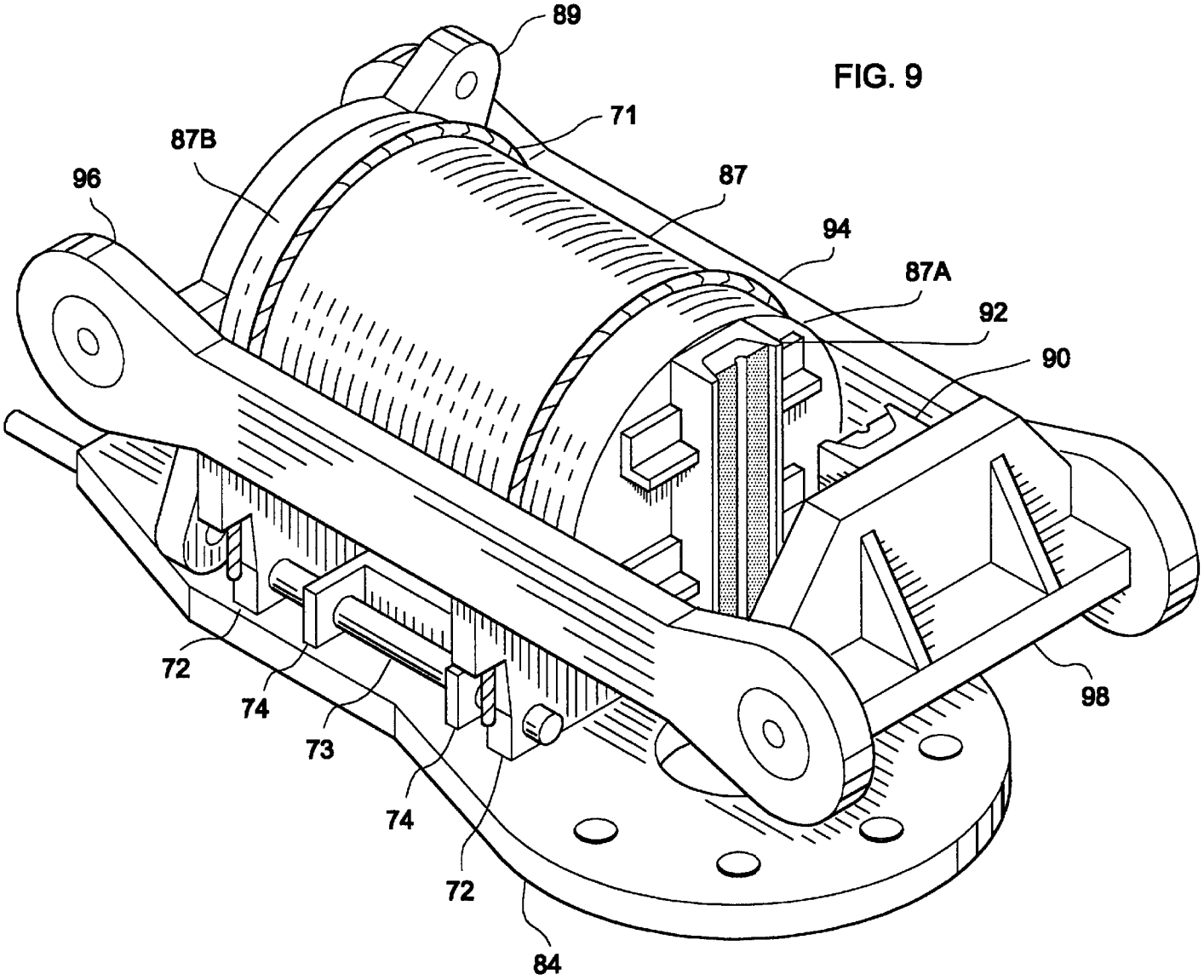
FIG. 9 is a perspective view of a clamp, in open position, for use with a well string injector according to the invention.
Figure 10:
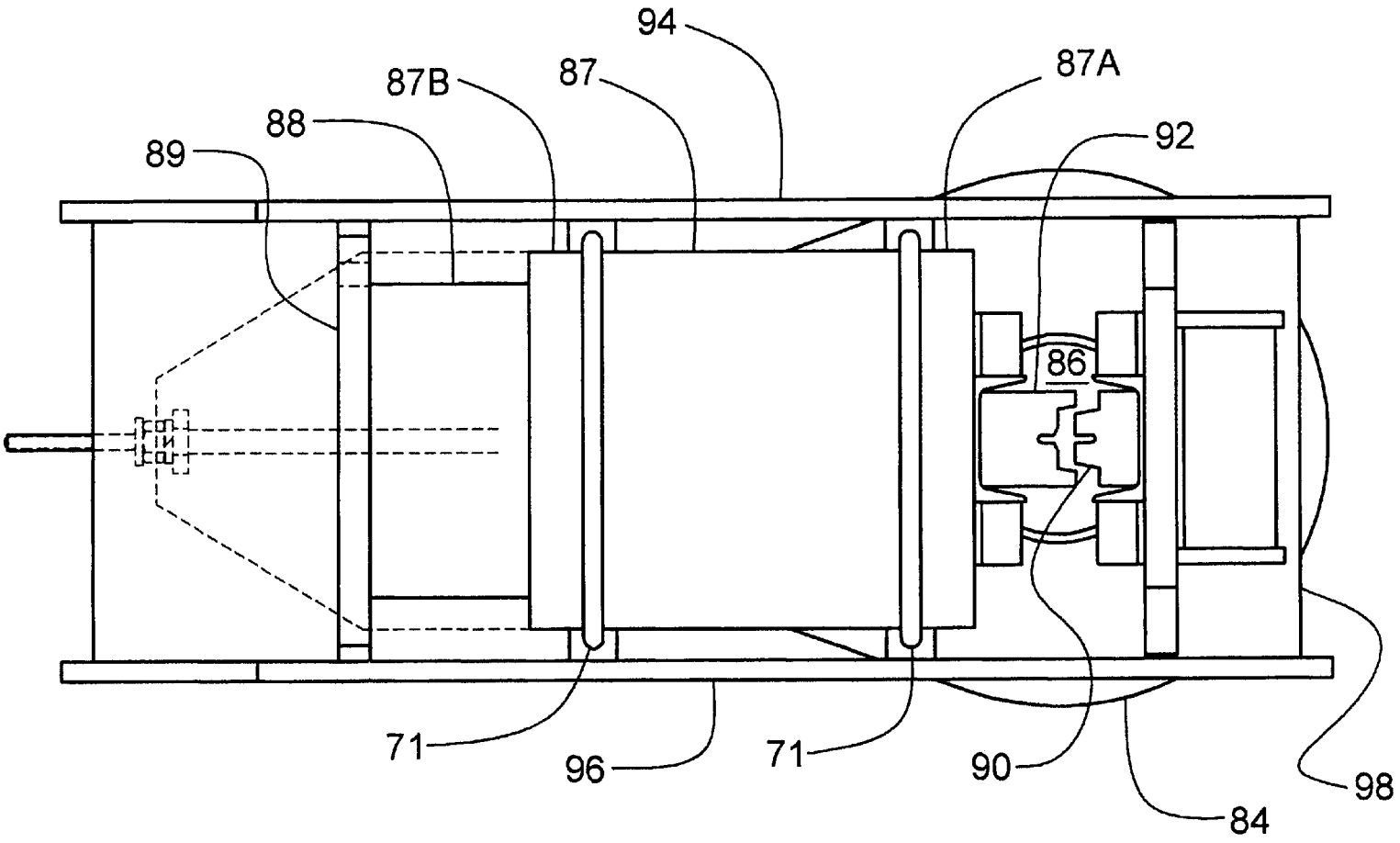
FIG. 10 is a plan view of a clamp, in closed position, for use with a well string injector according to the invention.
Figure 11:
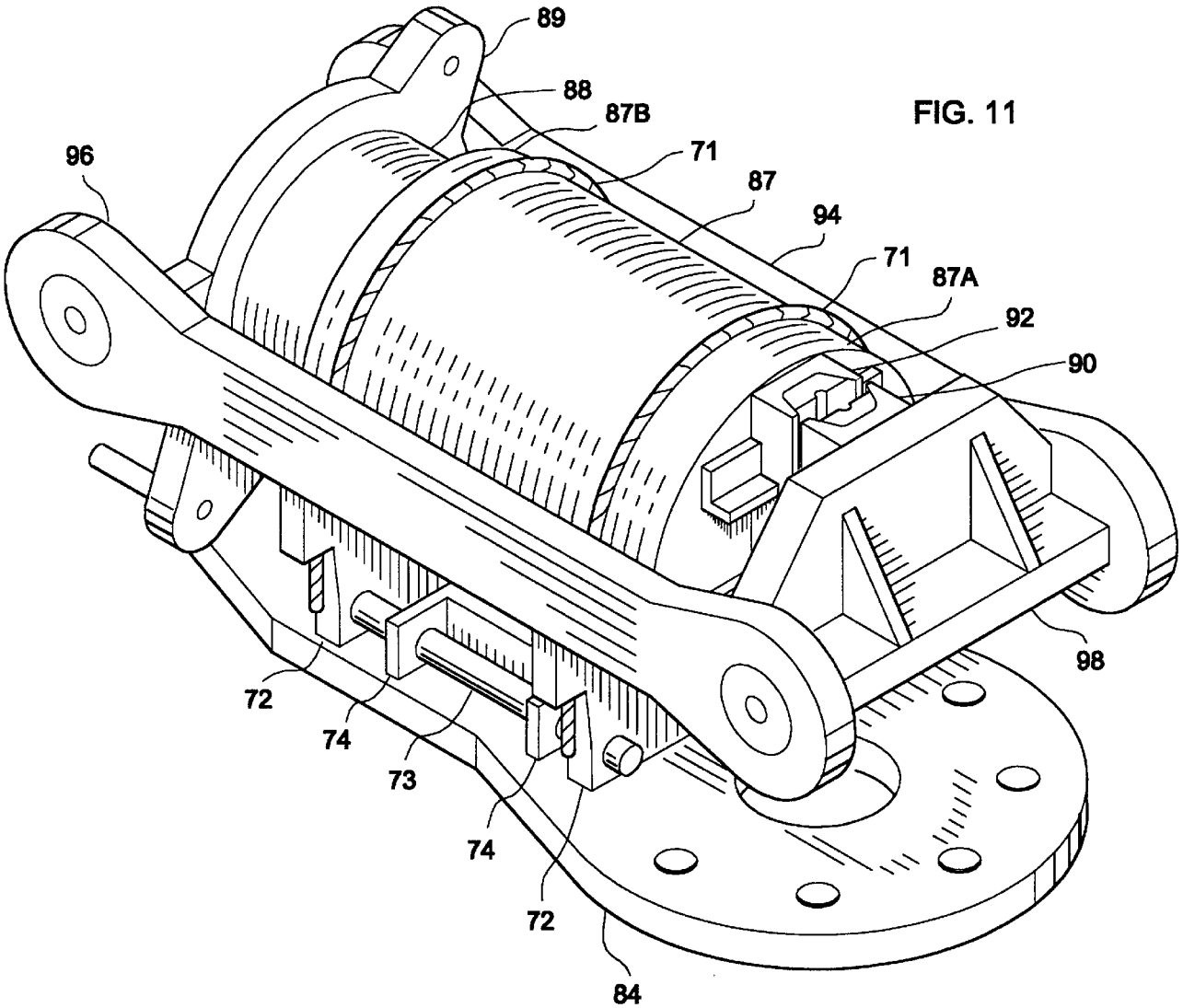
FIG. 11 is a perspective view of a clamp, in closed position, for use with a well string injector according to the invention.
Figure 12:
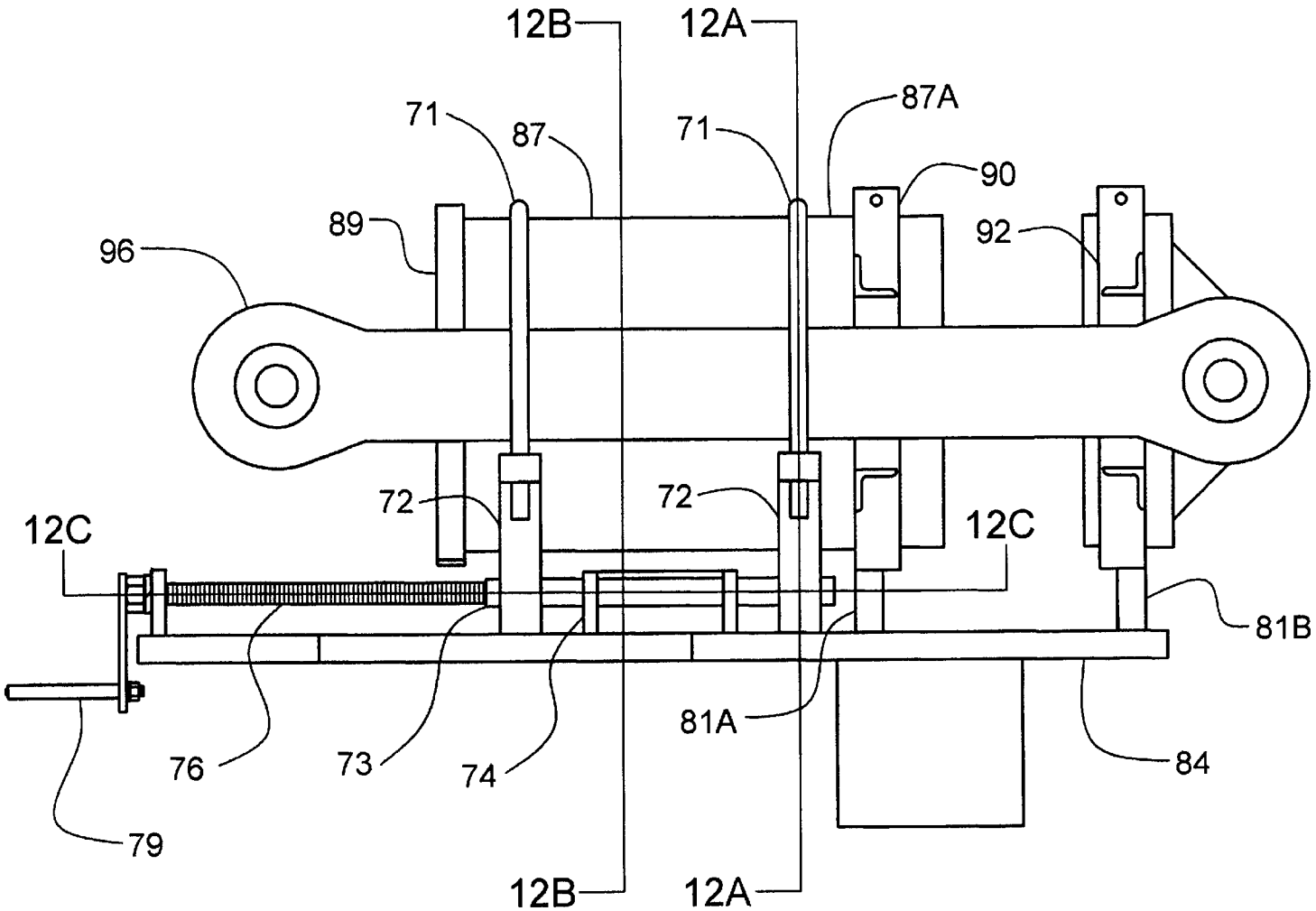
FIG. 12 is a side view of a clamp, in open position, for use with a well string injector according to the invention.
Figure 12A:
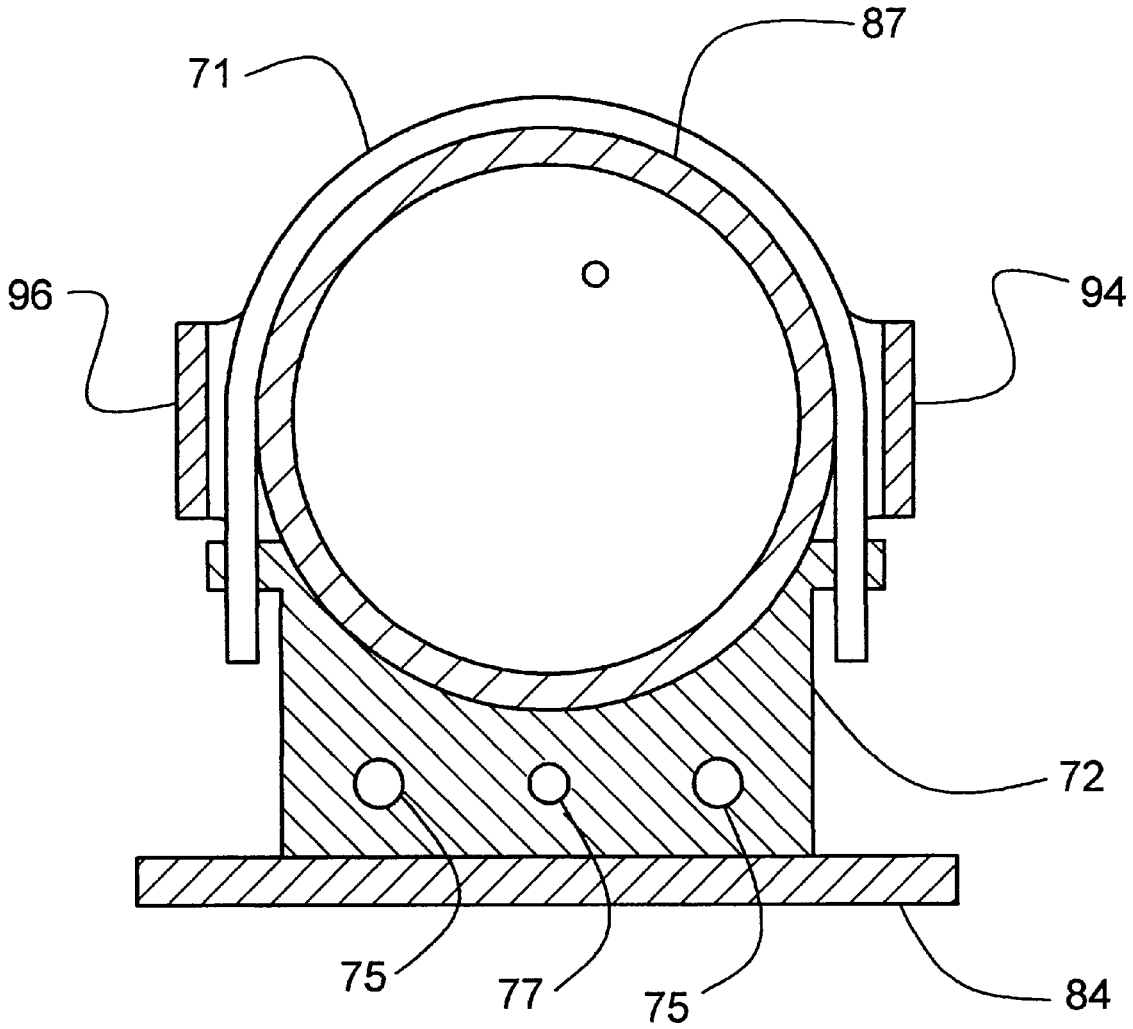
FIGS. 12A, 12B and 12C are respectfully cross-sections along the lines 12A, 12B and 12C in FIG. 12.
Figure 12B:
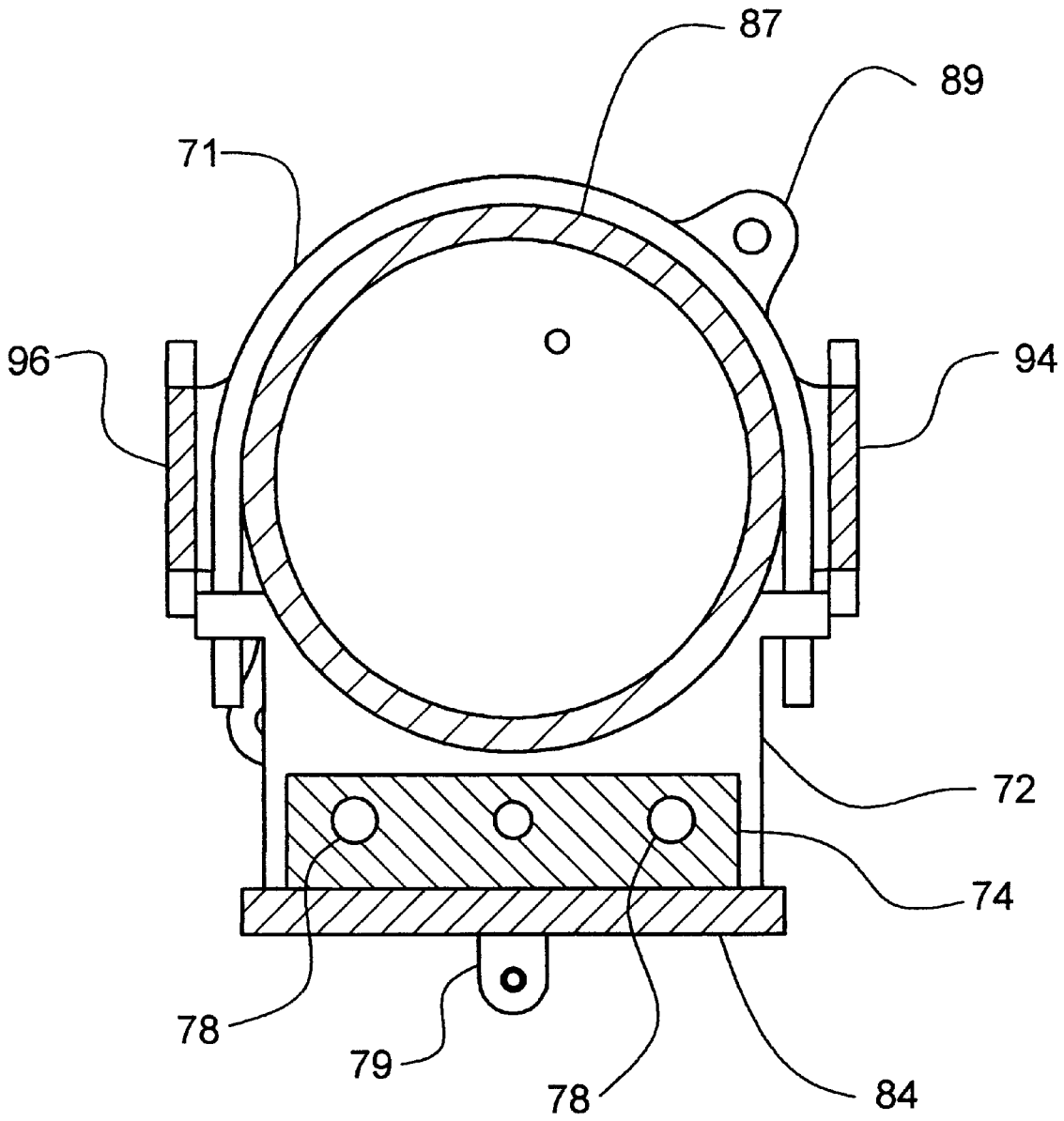
Figure 12C:
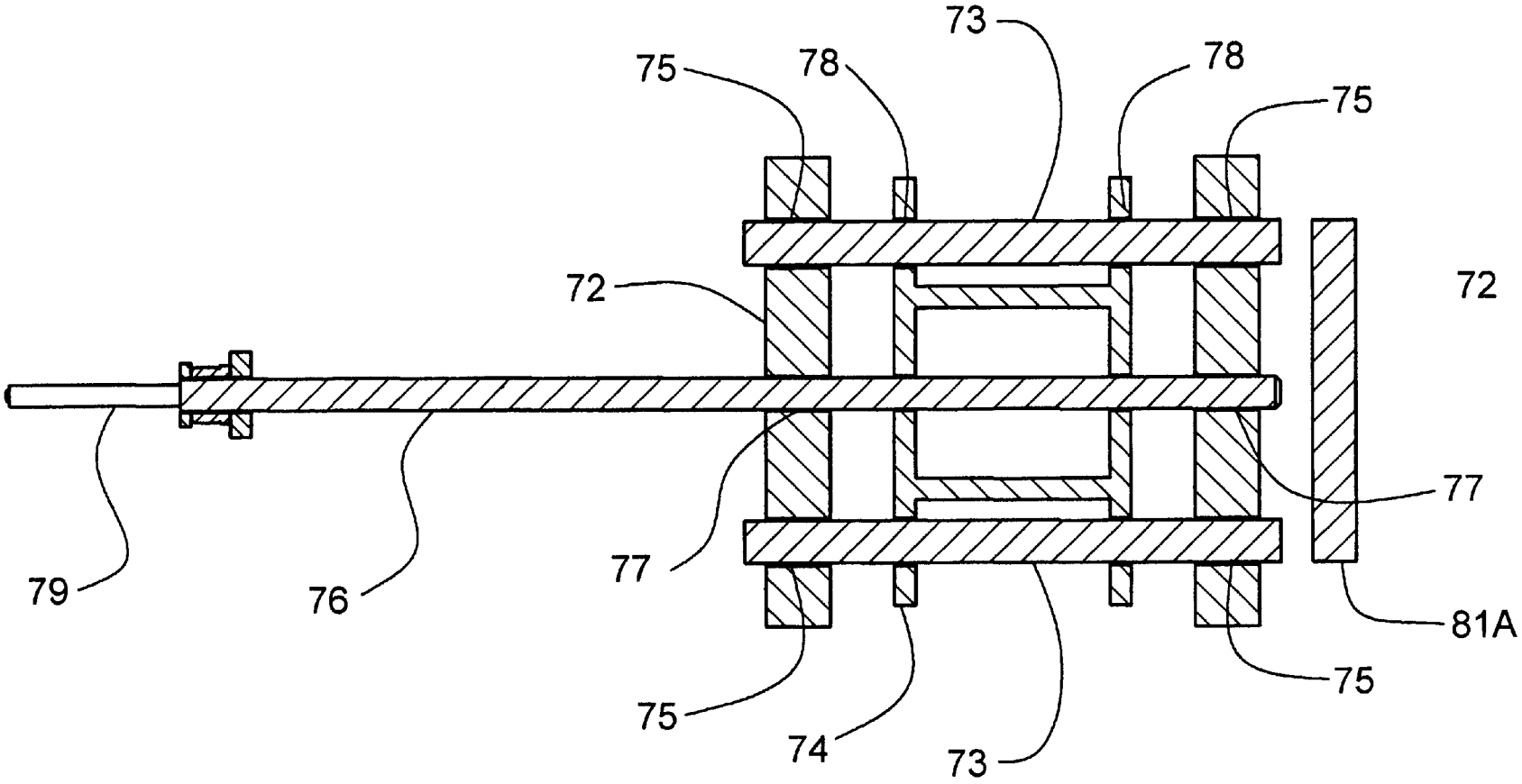
Figure 13:
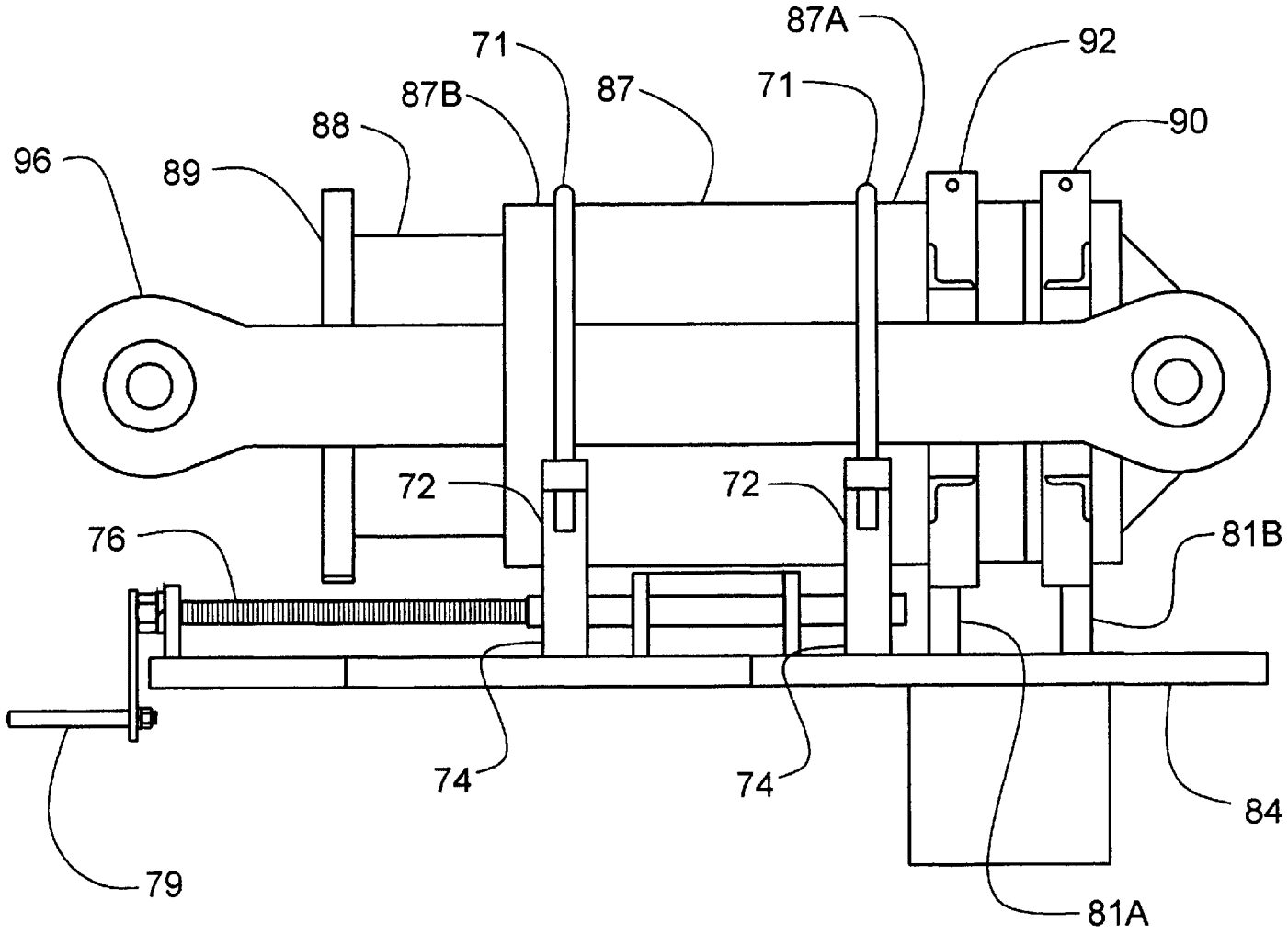
FIG. 13 is a side view of a clamp, in closed position, for use with a well string injector according to the invention.
Figure 14:
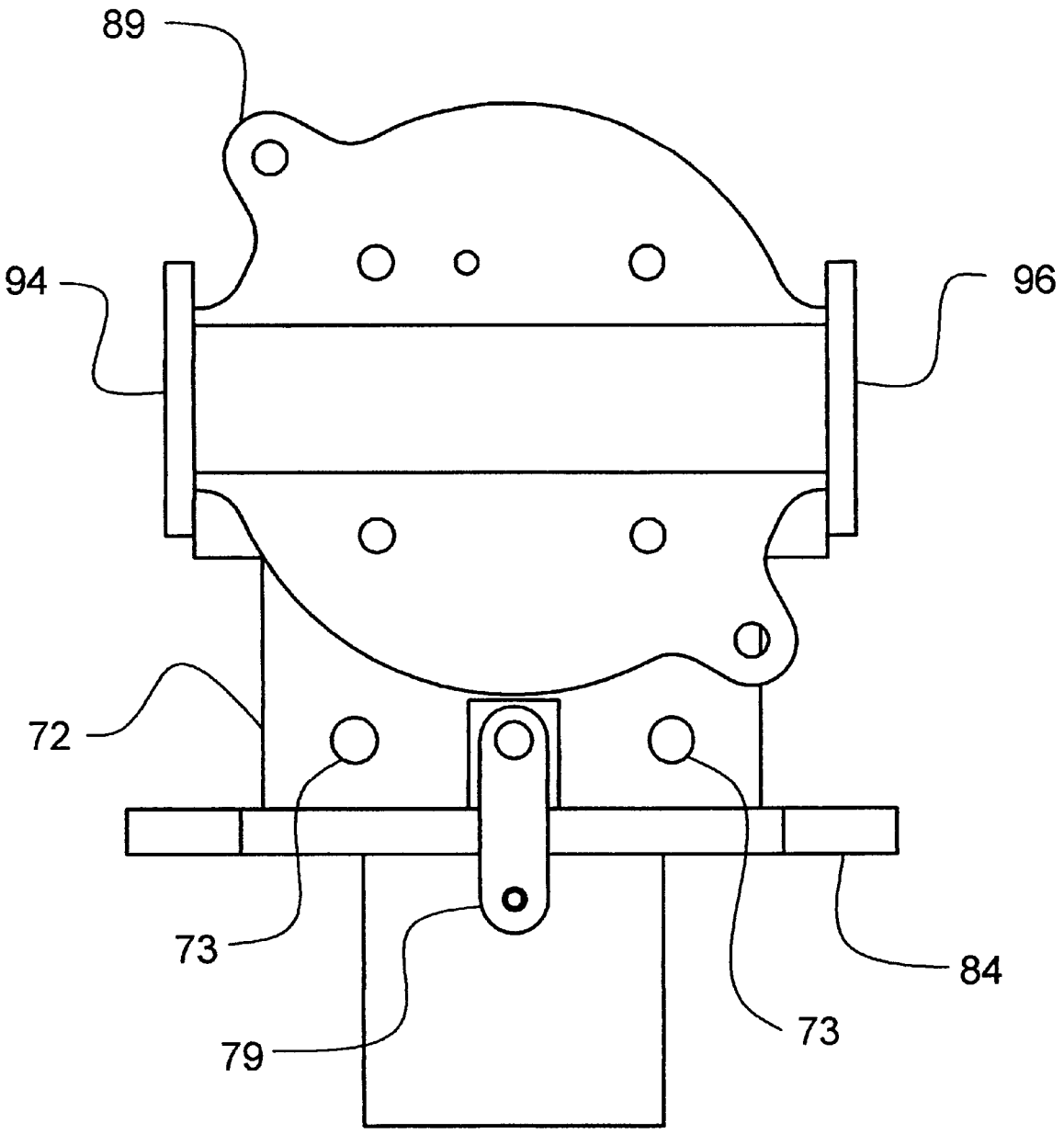
FIG. 14 is an end view (piston end) of a clamp for use with a well string injector according to the invention.
Figure 15:
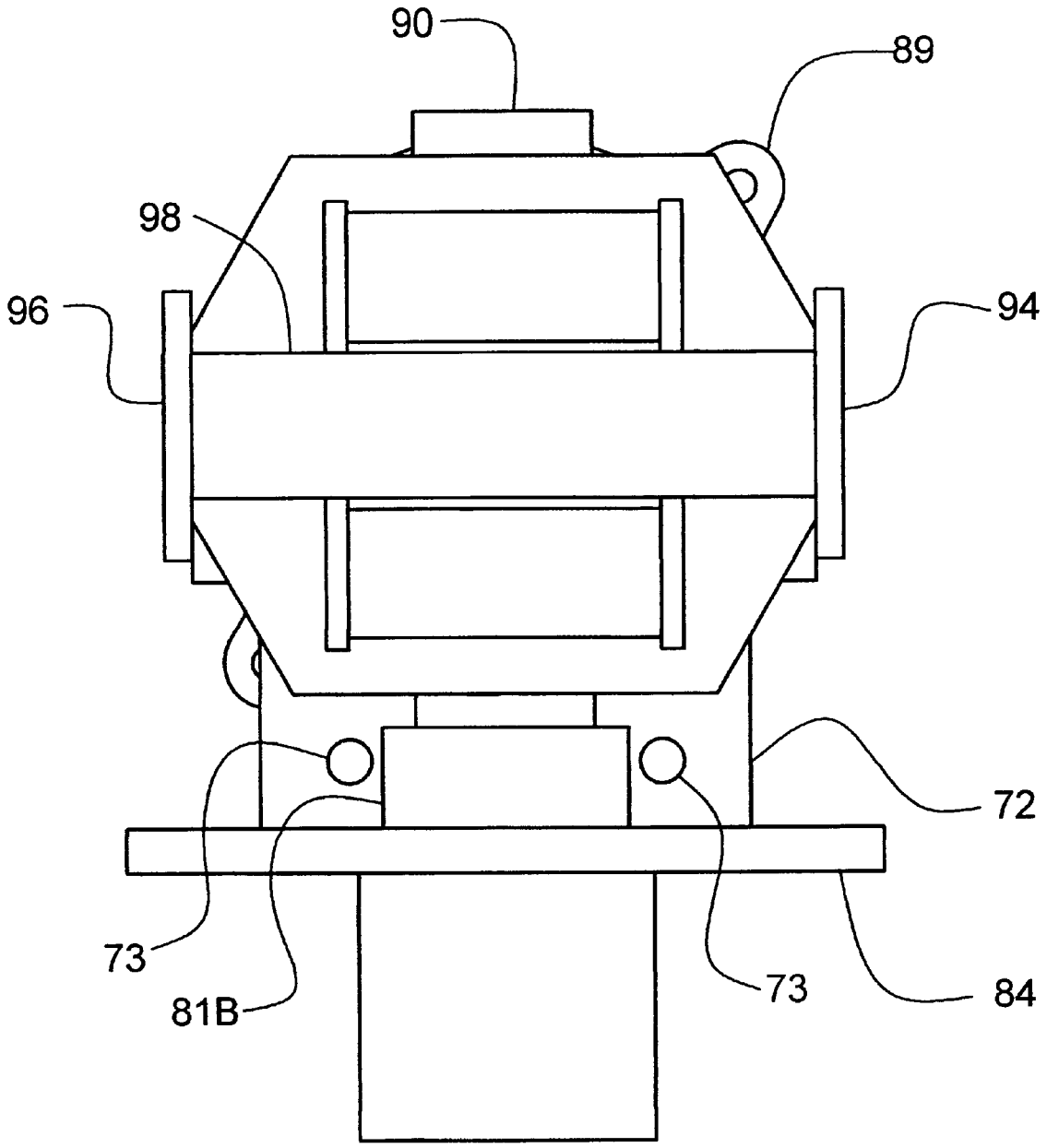
FIG. 15 is an end view (clamping end) of a clamp for use with a well string injector according to the invention.
Figure 16:
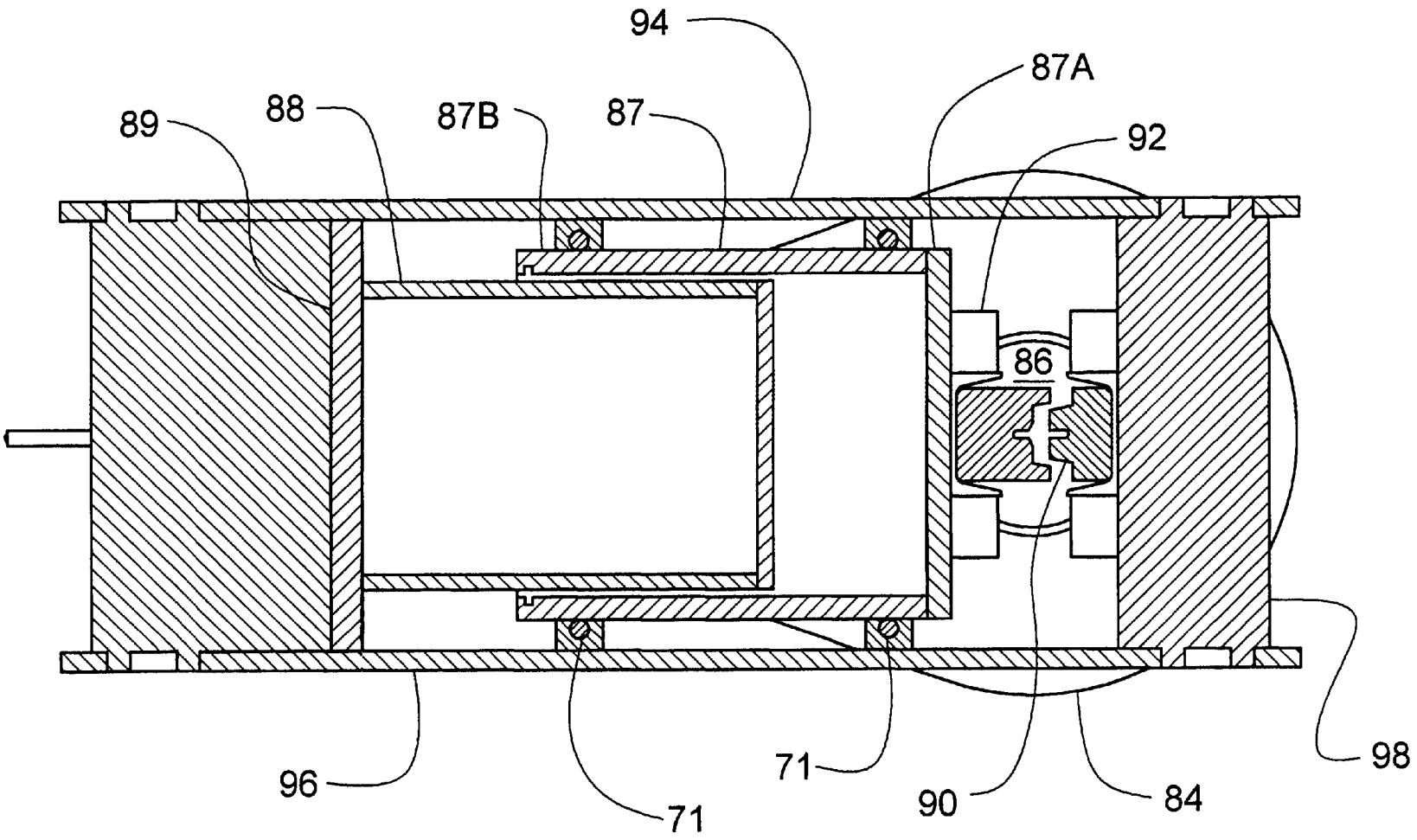
FIG. 16 is a section through a clamp, in closed position, for use with a well string injector according to the invention.

Referring to FIGS. 7A–7D, the carousel 60 is formed of a central spool 62 with arms 64 pivotally attached to and extending outward from the spool 62. Two arms 64A are fixed respectively to the upper and lower flanges 63 and 65 of spool 62 at diametrically opposed fixed points 66 shown for the upper flange 63 in FIG. 7D. The other arms 64 are pivotally attached at pivot points 68 also shown in FIG. 7D to both the upper and lower flanges 63 and 65. The arms 64, 64A comprise upper and lower arm rods that converge at their outer ends, such that the upper and lower rods and the spool 62 form triangular arms. At the outer extremity of each arm is a U-shaped channel 67 for receiving the well string. The spool 62 rotates on base 69. One part 61 of the base 69 extends to the outer edge of the arms to act as a guide for guiding the well string into the U-shaped channels 67. The guide part 61 is fixed in relation to the arms 64, 64A. When spaced evenly about the spool 62 as shown in FIG. 7C, the arms 64, 64A may carry well string, and rotate with the spool 62, as well string is pushed through the guide part 61 into the channels 67. When not in use, the arms 64 rotate (intermediate position shown in FIG. 7B) about their pivots to be parallel to the arms 64A as shown in FIG. 7A, which is convenient for storage.

Referring to FIGS. 8–16, there is shown a clamp 30 for gripping well string. The clamp 30 is formed from a first clamping member 80 and a second clamping member 82 and is so oriented on the frame 14 to provide clamping forces on well string by relative movement between the first and second clamping members 80, 82 predominantly in a transverse direction to the frame longitudinal direction.

The clamp 30 sits on a base 84, which is bolted to the sub-frame 44 (clamp 32) or the top plate 39 of lower beam 18 (clamp 30). The base 84 has an opening 86 for receiving well string. The second clamping member 82 is preferably adjustably fixed to the base 84 so that a gripping die 92 is located such that well string gripped by the gripping die 92 is centrally located within the opening 86. A pedestal 81A is secured to the die 92 and slides on the base 84 to support the die under tension caused by a well string held by the clamp 30, 32. Various mechanisms may be used to adjustably secure the clamping member 82 to the base 84 for limited transverse motion in relation to the frame. In the example shown in FIGS. 8–16 and FIGS. 12A–12C, curved rods 71 are clamped around the cylinder 87 and secured in brackets 72. Brackets 72 sit on top of the base plate 84. Rods 73 interconnect the brackets 72 so that the frame composed of rods 73 and brackets 72 moves as a unit on the base plate 84. A smaller frame is formed of parallel brackets 74 which are welded to the base plate 84. The rods 73 pass through holes 75 in the brackets 74. A threaded rod 76 passes through holes 77 and 78 in the brackets 72 and 74 respectively. The threaded rod 76 should be axially fixed in relation to one pair of the brackets 72, 74 and threaded into the other pair. Rotation of threaded rod 76 by crank 79 causes the frame formed of rods 73 and brackets 72 to move over the base plate 84.

The second clamping member 82 is formed of a cylinder 87 mounted on the base 84 so as to have its longitudinal axis transverse to the frame 14. The cylinder 87 has an open end 87B and a closed end 87A, the gripping die 92, which is carried preferably on the closed end 87A, and the mechanism for securing the cylinder 87 to the base 84. Hydraulics for the cylinder 87 are discussed in more detail with reference to FIG. 25.

The first clamping member 80 is formed of a piston 88 received in the open end 87B of the cylinder 87 for translational movement within the cylinder 87, a backing plate 89 for the piston. A pair of clamping arms 94 and 96 are fastened to the backing plate 89 and extend on either side of the cylinder 87 beyond the gripping die 92. The clamping arms 94, 96 are secured together at their ends remote from the piston 88 by a die block 98, on which is mounted a gripping die 90 in a position opposed to the gripping die 92 for gripping well string. Gripping die 90 is supported against longitudinal movement due to the weight of a well string by a pedestal 81B that is secured to the die 90 and that is free to move transversely over the pedestal 81B. In operation, the gripping die 92 is held fixed in relation to the base 84 and frame 14, while the gripping die 90 is moved in a predominantly transverse direction in relation to the frame 14 towards and away from the gripping die 92 to grip (closed position in FIGS. 10, 11, 13) and release well string (open position in FIGS. 8, 9 and 12) as required.

The cylinder 87 is shown as being single acting. In that case, some method must be used to forcibly retract the piston 88 when well string is moving through the clamp. One way to do this is to place springs on the gripping dies 90 and 92. Another way is to provide retraction cylinders. If the cylinder 87 is double acting, then additional retraction means are not required.

The piston 88 and cylinder 87 may be reversed, so that the arms extend from the cylinder 87 and the gripping die 92 is carried by the piston 88, but this design is not preferred, since the design shown is better able to withstand longitudinal forces on the clamp.

Figure 18:
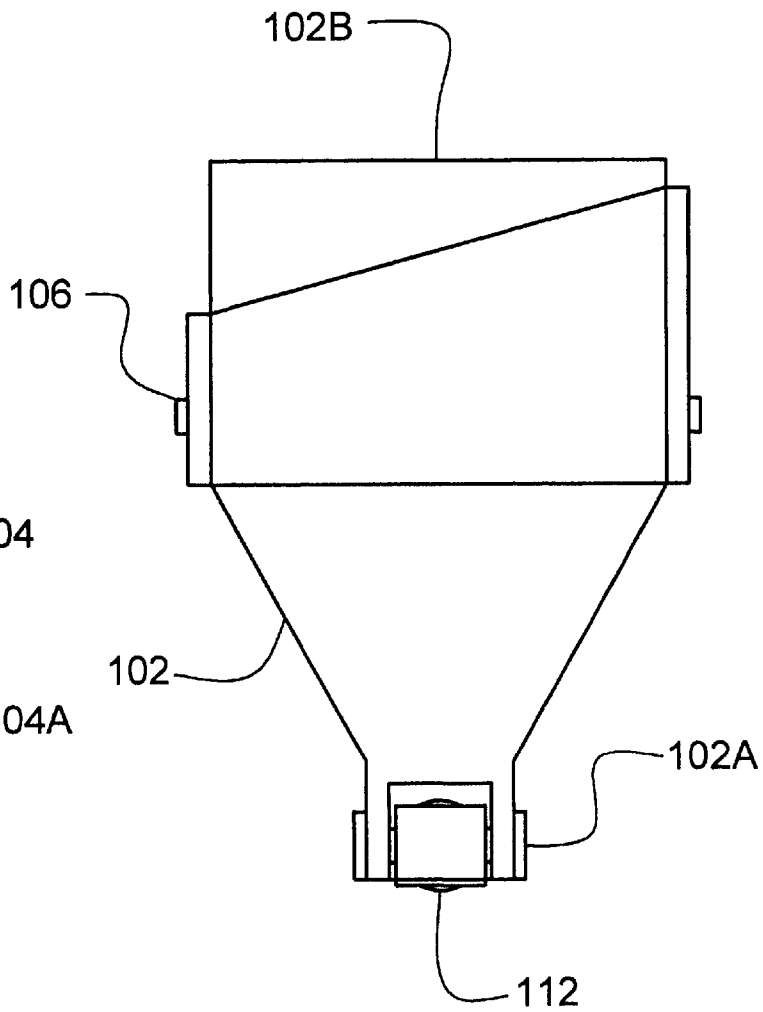
FIG. 18 is a side view of an open sided clamp, for use with a well string injector according to the invention.
Figure 17:
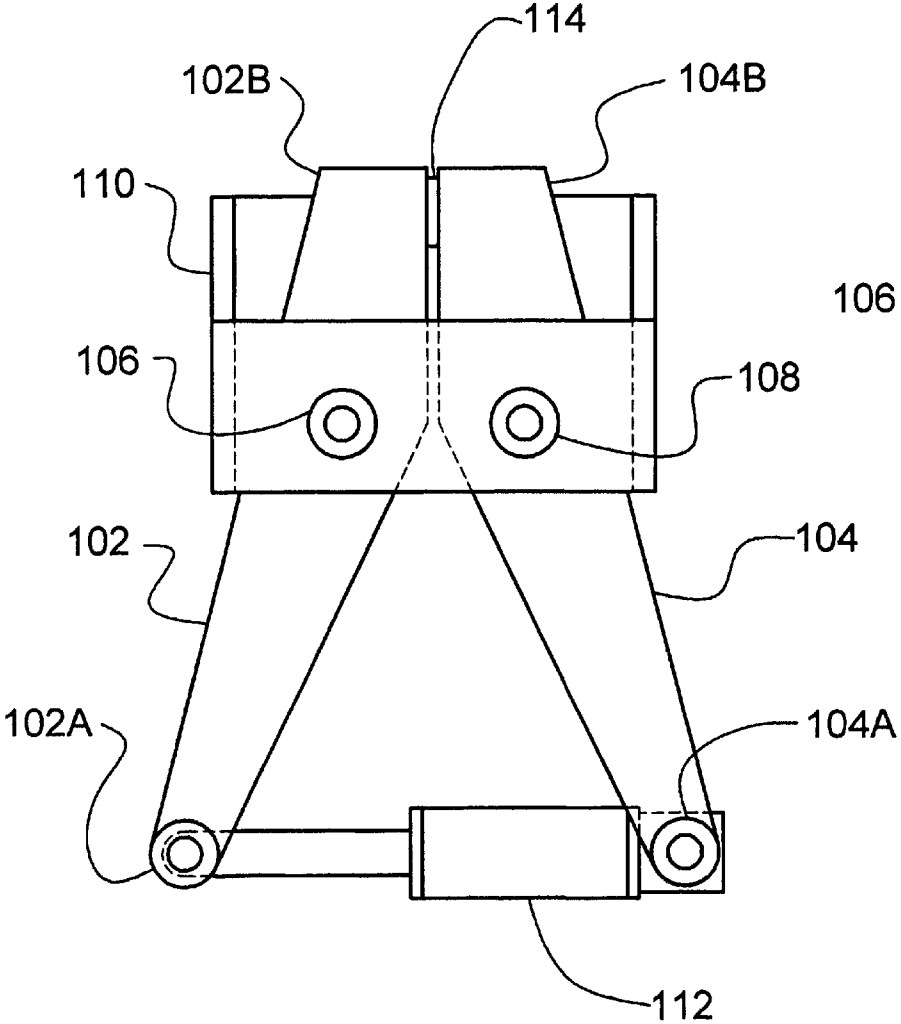
FIG. 17 is a plan view of an open sided clamp for use with a well string injector according to the invention.
Figure 19A:
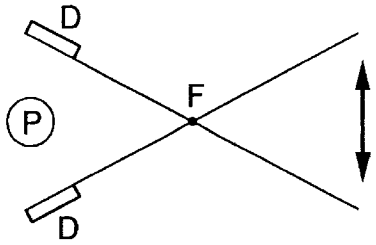
FIGS. 19A–19D are schematics showing possible clamp configurations for use with the invention.
Figure 19B:
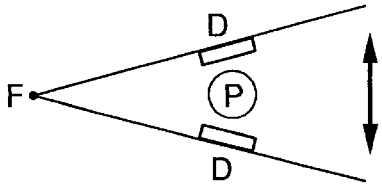
Figure 19C:
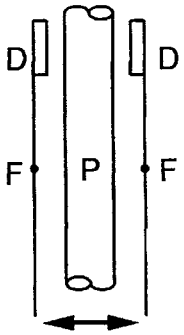
Figure 19D:
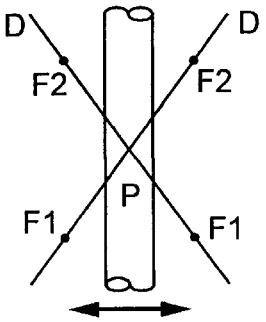

In an alternative embodiment, shown in FIGS. 17 and 18, the clamps 30, 32 may be formed with clamping members that pivot with respect to each other. Various configurations of pivoting clamps are shown in FIGS. 19A–19D, wherein F, $F_1$ and $F_2$ are fulcrums about which the clamping members pivot, D refers to gripping dies, and P indicates the pipe or other coilable product. The double ended arrow indicates the location of a force applicator such as a hydraulic ram that applies translational force to the clamping members to cause them to clamp onto the pipe or other coilable product. FIG. 19A shows a plier type clamp. FIG. 19B shows a nutcracker type clamp. FIG. 19C shows a plier type in which the fulcrums of the respective clamping members are separated spatially. FIG. 19C shows a plier type in which the fulcrum and die of each clamping member are on opposite sides of the pipe. In each case, the fulcrum is located with respect to the die such that the force exerted by the die on the pipe is predominantly transverse to the pipe.

Referring to FIG. 17, clamping members 102 and 104 pivot respectively about pivots 106 and 108 on a mounting block 110. The mounting block 110 is mounted on the frame 14, in similar manner to the base 84. A double acting hydraulic cylinder 112 is pivotally connected between respective ends 102A and 104A of the clamping members 102 and 104. A pair of gripping dies 114 are mounted on respective ends 102B and 104B of the clamping members. The pivots 106, 108 are thus connected between the ends 102A, 102B and between the ends 104A, 104B respectively. The hydraulic cylinder 112 opens and closes the clamping members as required.

Figure 21A:
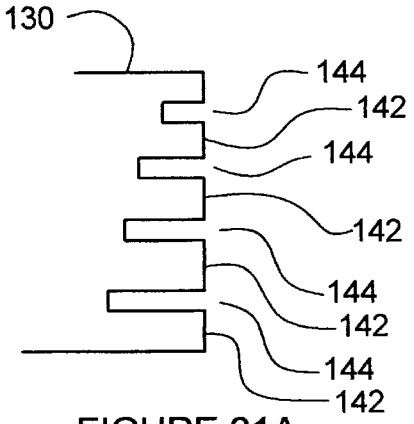
FIG. 21A is a section through a well string gripping die according to an aspect of the invention.
Figure 21B:
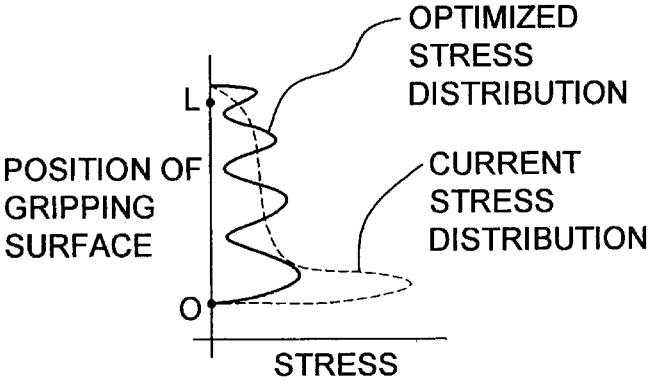
FIG. 21B shows stress distribution along the well string gripping die of FIG. 21A in use.
Figure 20:
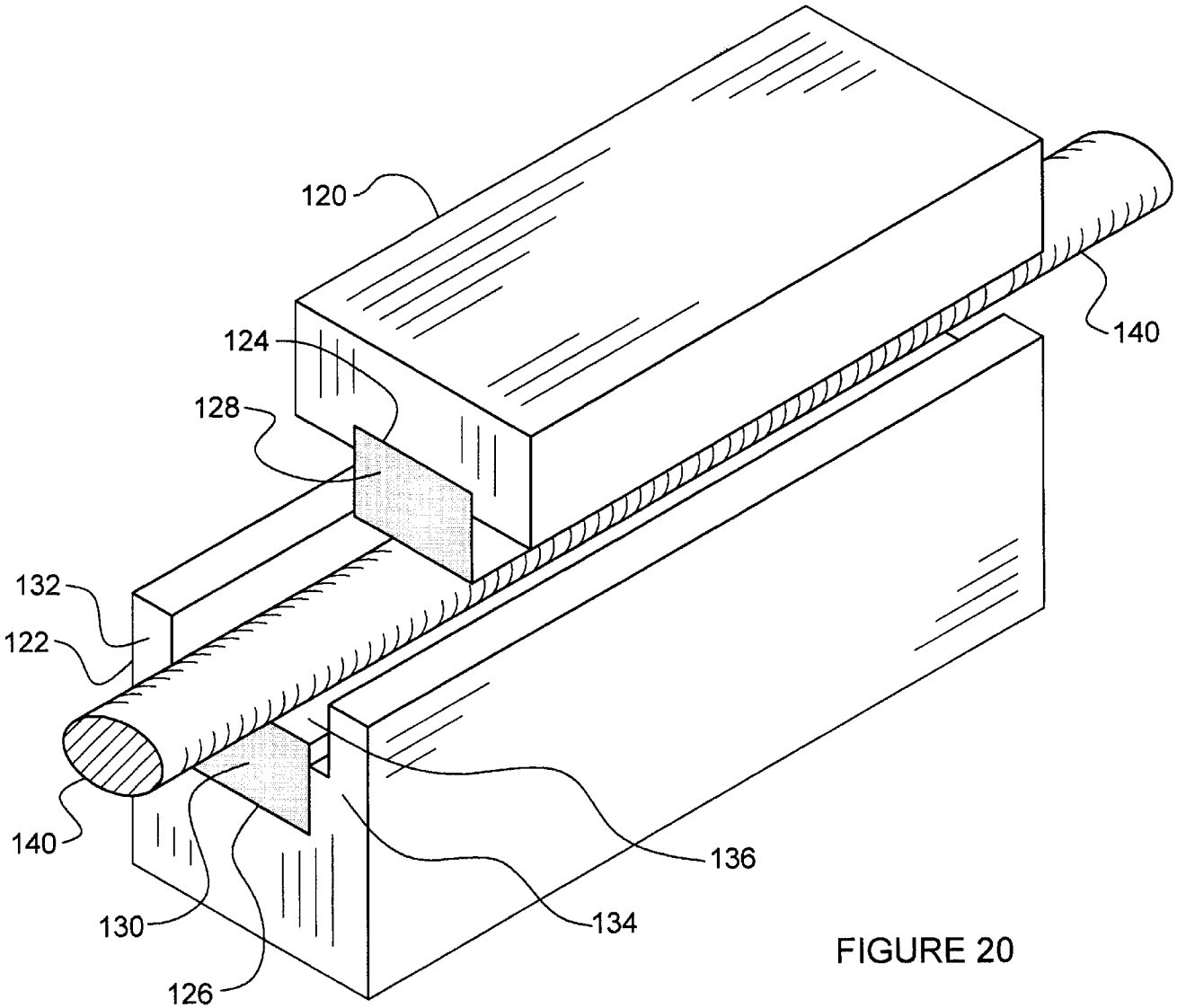
FIG. 20 is a perspective view of a well string gripping die according to an aspect of the invention.
Figure 22:
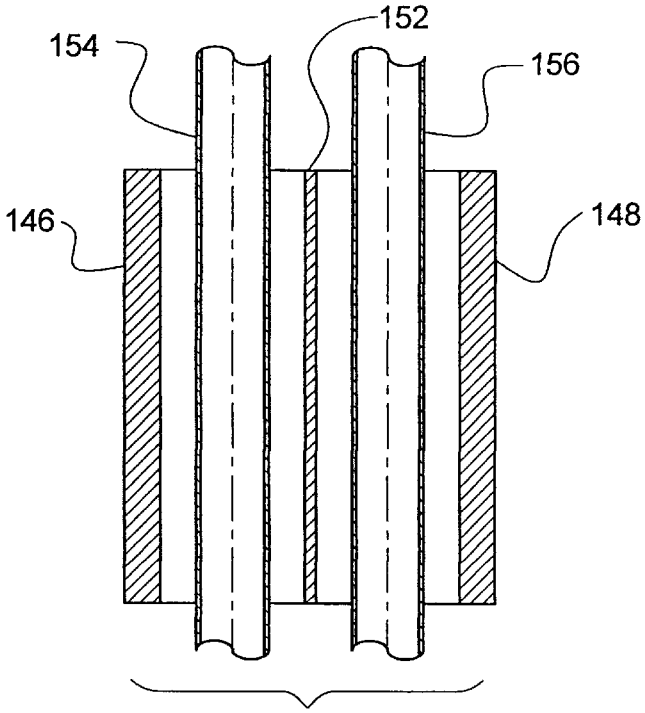
FIG. 22 is a longitudinal section through gripping dies in open position used to clamp parallel tubing strings.
Figure 24:
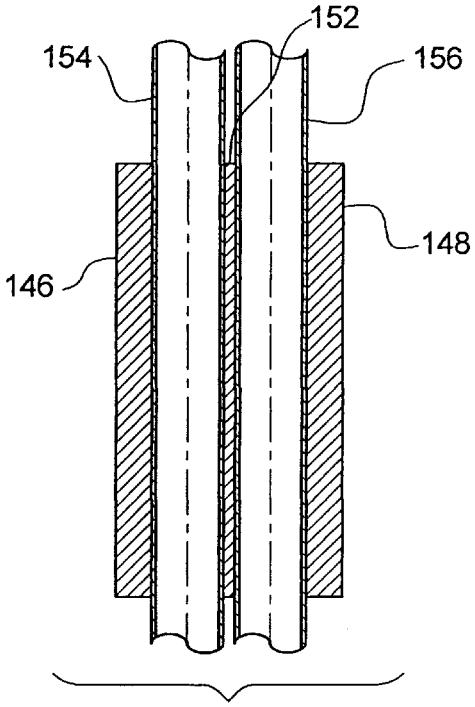
FIG. 24 is a longitudinal section through gripping dies in closed position used to clamp parallel tubing strings.

The gripping dies 90, 92, 114 are illustrated in FIGS. 20, 21A and 21B. Each gripping die 90, 92, 114 is formed of a pair of gripper housings 120, 122. Each gripper housing 120, 122, has a groove 124, 126 formed in a front face of the gripper housing for receiving gripper pads 128, 130, respectively. Gripper housing 122 has a pair of barrier walls 132, 134 extending from the face of the gripper housing 122 forward of and beyond the gripper pad 130. These barrier walls 132, 134 extend sufficiently forward of the front face 136 of the gripper pad 130 to prevent walk out of well string gripped by the gripping dies. For example, it is preferred that the barrier walls 132, 134, extend forward of the front face 136 of the gripper pad 130 more than one half the thickness of the well string 140. Alternatively, one of the barrier walls 132 may be carried by the gripper housing 120 and the other carried by the gripper housing 122 on opposite sides of the gripping die. The gripping dies 90, 92, 144 are preferably mounted on the clamping members such that they are readily removable, as by bolting. The gripper assembly in FIG. 20 can be used to advantage in chain type of injectors such as disclosed in U.S. Pat. No. 3,559,905.

The front face 136 of the gripper pad 130, and likewise for the front face of the gripper pad 128, should have a sufficiently smooth surface, free of sharp teeth, or sharp edges, that well string gripped by the gripping dies is not damaged or scratched by the gripping dies during operation. The front face 136 is preferably configured, however, as shown in FIG. 21A with flat topped teeth 142 and gradually deepening grooves 144 (deepening in the expected direction of tension caused by weight of the well string) such that the gripping surface 136 induces an optimized stress distribution along the length L of the gripping surface, illustrated in FIG. 21B, in well string clamped by the gripping dies when the well string is in tension.

Figure 23:
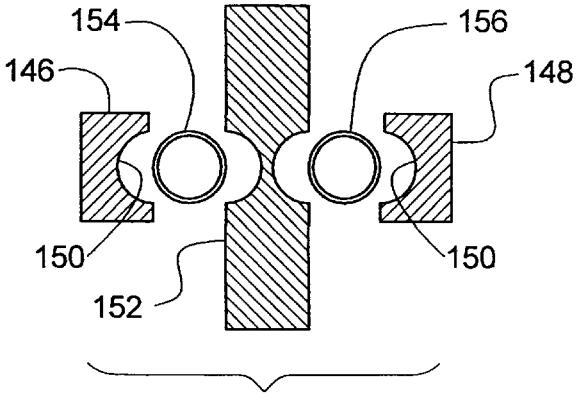
FIG. 23 is a cross-section through gripping dies in open position used to clamp parallel tubing strings.
Figure 25:
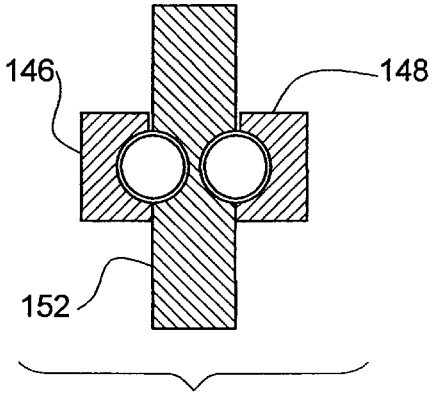
FIG. 25 is a cross-section through gripping dies in closed position used to clamp parallel tubing strings.

For gripping tubing, circular recesses 150 in the gripper pads 146 and 148 may be used as illustrated in FIGS. 23 and 25. The curvature of the recesses 150 should match the curvature of the tubing to be gripped. Pads 146 and 148 may otherwise be desired in similar fashion to the pads 128, 130. As shown in FIGS. 22–25, an intermediate gripping die 152 may be carried by the clamps 30, 32 (such as by a bar, not shown, attached to the base 84) for location between parallel spaced well string 154, 156 clamped by the clamp 30, 32. In this way, parallel well strings 154, 156 may be injected into the well together. Strings 154 and 156 are shown in series, however, they could be in parallel, however, greater clamping forces would be required. In this embodiment, a second or wider guide should be provided at the end of the frame, and the opening 86 in the base 84 should be widened to accommodate both well strings. Numerous parallel well strings may be injected together.

Figure 26:
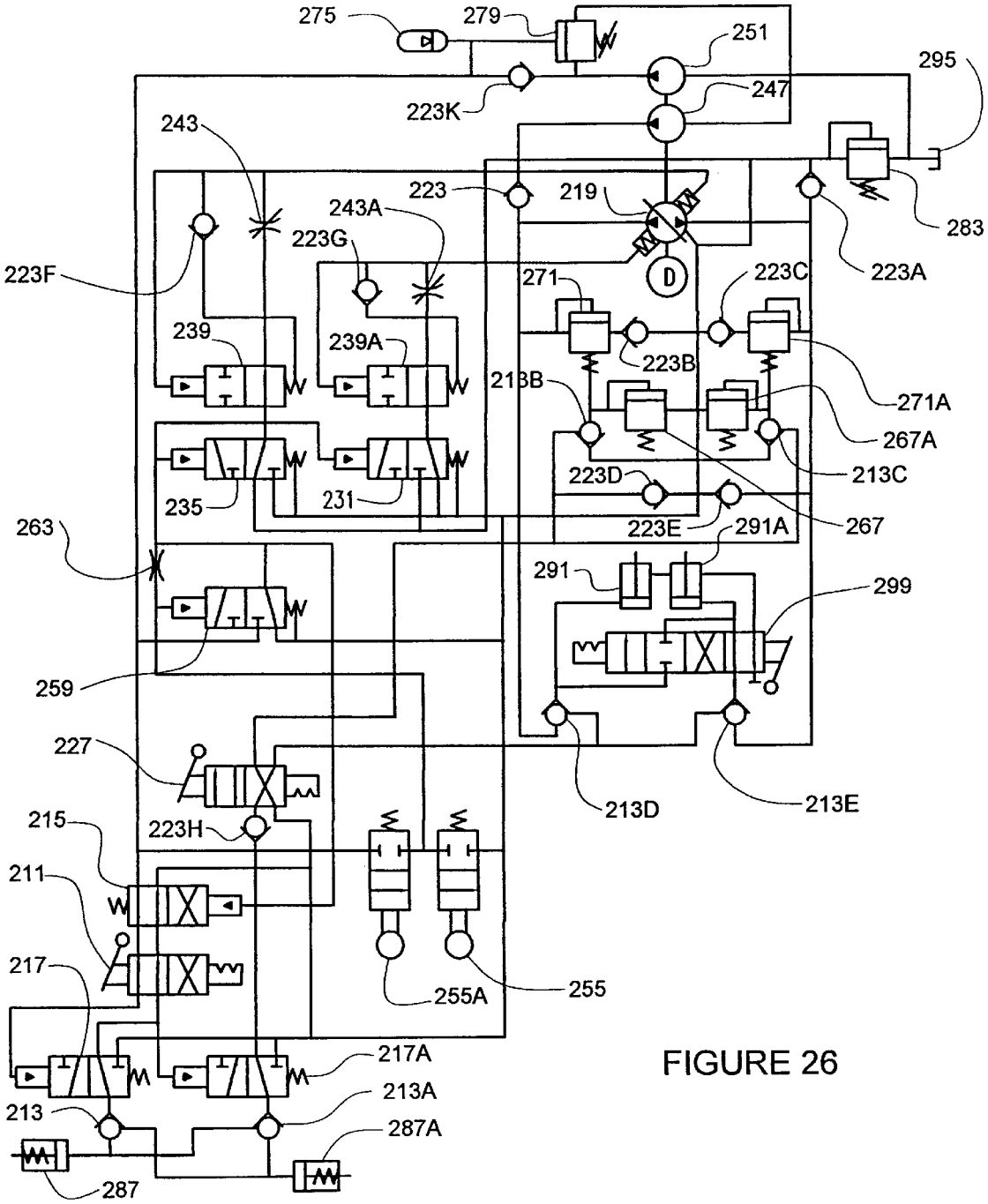
FIG. 26 is a schematic showing exemplary hydraulics for use with a well string injector according to the invention.
Figure 27D:
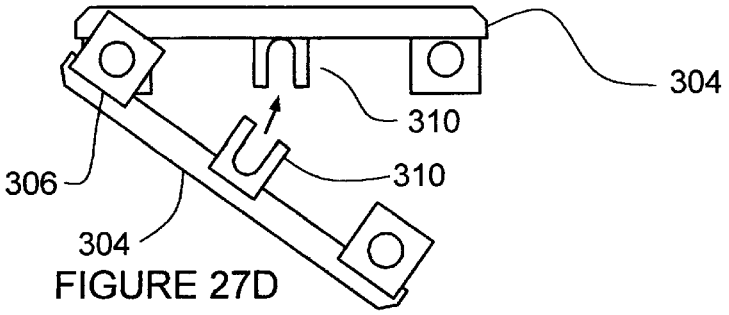
FIGS. 27C and 27D are top views of a clamp on top of the auxiliary ram of FIGS. 27A and 27B in closed and open positions respectively.
Figure 27C:
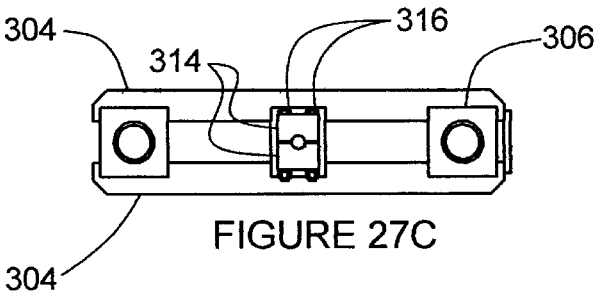
Figure 27A:
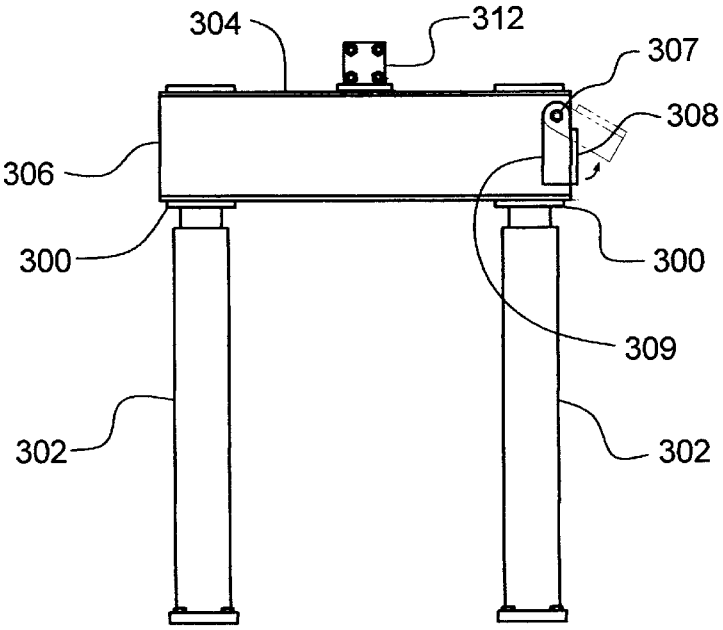
FIGS. 27A and 27B show respectively two side views of an auxiliary ram for use in unseating stuck well string.
Figure 27B:
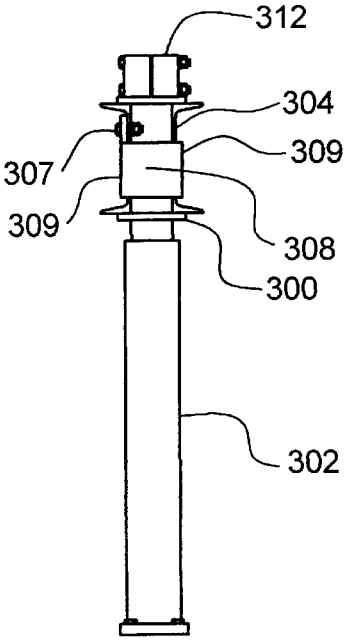

Hydraulics for the clamps 30, 32 are shown in FIG. 26. In this description, cylinders 291 and 291A are the double acting cylinders 34 and 34A shown in FIG. 1A for example, and cylinders 287 and 287A are cylinders 87 of upper and lower clamps 30 and 32 shown in FIG. 1 or 1A for example. The circuit of FIG. 26 may be used with a single cylinder 34 as shown in FIG. 1, with cylinder 291A not used with the appropriate changes to the cylinder connections, this would permit the use of only one cylinder.

Pump 247 draws hydraulic fluid from tank 295, this pressurized fluid transmits power to the supplies of valve 231 and of valve 235. This pump 247 supplies hydraulic fluid through check valve 223 and check valve 223A and if the pressure raises above a preset level it is relieved through relief valve 283 to tank 295. Pump 247 also supplies alternately through check valves 223 and 223A make up hydraulic fluid for the closed loop hydraulic system supplied by pump 219.

Pump 251 draws hydraulic fluid from tank 295 and supplies this fluid through check valve 223K to accumulator 275 and through the supplies of valve 259, valve 215, through valve 215 to valve 211, valve 211 is a selector valve for choosing the sequencing of cylinder 287 and cylinder 287A with cylinders 291 and 291A, valve 217, valve 217A, valve 255 and the supply of valve 227 through check valve 223H. Valve 279 is the relief valve which protects the circuit powered by pump 251.

Pump 219, a variable volume pump supplies a closed loop hydraulic circuit that drives cylinders 291 and 291A. Pump 219 draws make up hydraulic fluid from pump 247 alternately through check valves 223 and 223A. Hydraulic fluid from pump 219 and pump 247 is supplied appropriately to valve 271, valve 271A, valve 223D, and valve 223E and to cylinders 291 through valve 213D and 213E. The swash actuators in pump 219 are controlled by valve 231, valve 235, valve 239, valve 239A, valve 243, valve 243A, valve 223F and valve 223G.

Prior to start up, valve 227 should be set in the safety position, and valve 211 can be set in either position. After start up (as mentioned previously) pump 247 provides pressure to the supplies of valve 231 and 235 and also through check valves 223 and 223A to relief valves 271 and 271A and then through check valves 213D and 213E to cylinders 291 and 291A. Pump 251 supplies pressure through check valve 223K to accumulator 275 and to the supply of valve 251 and through 223H to valve 227 and also to valve 255 and also to the supply of valve 217 and valve 217A. Because valve 227 is shifted to the safety position pressure goes through valve 227 and activates the pilots of piloted check valve 213B and piloted check valve 213C allowing any pressure connected with operating valve 267, valve 267A, valve 271, and valve 271A to vent through to tank 295. And at the same time, valve 227 being in the safety position permits the pilots on piloted check valve 213D and piloted check valve 213E to vent through to the tank thus closing check valve 213D and check valve 213E not permitting cylinder 291 to move in either direction.

After the hydraulic system is started and pressured up valve 227 can be shifted to the run position. This permits pressure to travel to the pilots of check valve 213D and check valve 213E opening them to allow movement in cylinders 291 and 291A and at the same time it allows check valves 213B and 213C to close allowing pressure from pump 247 to pressurize valve 267, valve 267A and consequently valve 271 and valve 271A allow any make up oil to go into the case of pump 219. This is allowed because relief valve 283 is set at a preset pressure.

After start up the shifting of valve 227 to the run position causes hydraulic fluid from pump 247, as mentioned previously, to go to the supply of valve 231 which is closed off and to the supply of valve 235 which is open permitting hydraulic fluid to send power through valve 239 and through check valve 223F plus allowing hydraulic fluid to pass to a swash plate actuator in pump 219 allowing it to actuate. After this is actuated, pressure is built up enough to activate the pilot of valve 239 and thus closing it off.

This movement of the swash actuator shifts the swash plate in pump 219 allowing fluid to travel from pump 219 through to check valve 213E and into cylinder 291 forcing the cylinder to move. After the cylinder has moved, the cylinder then actuates valve 255 and sends a hydraulic fluid power signal through the pilot of 259 forcing this valve to shift which then permits a power signal from pump 251 through accumulator 275 through valve 259 through the pilot of valve 215 which sends a signal permitting the same hydraulic fluid from pump 251 to send a signal through and also a pilot signal to valve 231 and valve 235. Pilot signal to valve 215 forces this valve to shift and send a pilot signal through valve 211 to valve 217 closing off one cylinder and releasing pressure from the other. Orifice 263 is in the circuit to provide make up oil for the pilot of valve 259 to ensure that it remains piloted until valve 255A is activated by cylinder 291.

The purpose of check valves 213 and 213A are to prevent cylinder 287 from releasing until cylinder 287A has been charged up and vice-versa.

This same signal from the pilot of valve 259 permits a power signal to reach valves 235 and 231. This shifts these valves and it causes the opposite swash actuator in pump 219 to actuate and the fluid from the previously actuated swash actuator to vent through valve 243 in a controlled manner. This will cause cylinder 291 to decelerate, stop and then accelerate in the opposite direction and after cylinder 291A is forced to extend by the shifting of the swashes sending oil from pump 219 through check valve 213E through valve 299 into the rear of cylinder 291A and this forces oil from the head of cylinder 291A through into the head of cylinder 291 causing it to retract.

After cylinder 291A has moved to its full stroke in the reverse direction, it actuates cam valve 255A causing the previous signal through valve 259 to vent thus valve 259 returns to its unactuated position closing off the pilot fluid that would be going to valves 235 and 231. This would cause everything to revert to the very start when valve 227 was first actuated.

The clamp cylinders 287 and 287A are shown on the schematic as being returned with the use of return springs or these clamps could have independent single acting return cylinders on them. The single acting return cylinder or cylinders on clamp 287 would be connected up to the line between valve 217A and valve 213A. The return cylinder or cylinders on clamp 287A would be connected up between valve 217 and valve 213. The return cylinders for clamps 287 and 287A could also be double acting cylinders, the clamps themselves could also be constructed as double acting cylinders but it is felt that the single acting cylinder is best suited for this operation.

Valve 299 would normally be set in a run position and would not be shifted except when the unit is first set up, if valve 299 is shifted then it permits fluid from pump 219 to actuate either both cap ends or rod ends of cylinder 291 and 291A. This would give double the amount of lifting force and could be used for unseating. For this purpose a separate valve would have to be installed to pressurize clamp 287 and clamp 287A simultaneously.

Cylinder 291 and cylinder 291A have valving installed either in the pistons or externally to permit hydraulic fluid to be routed from one end of one cylinder to the other end of the other cylinder to permit the balancing of these cylinders in case they get out of synchronisation. If the valving were installed directly in the piston this alignment would be done automatically, if the valving were installed externally, this would not be a automatic operation, but a manual adjustment.

The device described may be used to direct well string, or other strings, towards a target other than a well, for example a storage rack or pipeline.

In case of removal of stuck well string, it may be desirable to add a supplemental or auxilliary ram. This ram bolts onto the well string, and may be used to supplement the force supplied by the clamps. An example of such an auxiliary ram is shown in FIGS. 27A–27D. The auxiliary ram is mounted directly on the well head 12 or a supporting platform such as beam 18 (FIG. 1). The auxiliary ram is formed by a pair of rams 300 mounted in cylinders 302 which are mounted vertically on top of the well head 12. A pair of channel beams 304 span between the rams 300. The channel beams 304 are hinged together at one closed end 306 to form a jaw, and may be fastened together by a gate 308 at the open end of the jaw. The gate 308 is hinged to only one of the channel beams 304 at arm 307. Flanges 309 on each side of the gate 308 secure the beams 304 together. Each of the channel beams 304 has a centrally mounted yoke 310. A clamp 312 is secured to the top of the channel beams 304. The clamp 312 is formed of a pair of opposed gripping dies 314 through which pass bolts 316. Tightening of the bolts 316 secures the dies 314 against well string passing through the clamp 312. In operation, the yokes 310 pass around well string passing between the channel beams 304. The auxiliary ram works as follows. When well string is stuck in the well, the clamp 312 is secured to the well string, bolted together securely, and the cylinders 302 activated to apply additional force upward or downward on the well string in excess of the force that may be applied by the cylinders 34, 34A.

The synchronization of the clamping sequence is of great importance and it requires care and skill to ensure that this works consistently and satisfactorily in the manner as set out in this patent disclosure. The design, manufacture and use of the elements which grip onto the coilable products require care and attention so as not to damage the coilable product. There can be no sharp edges. This is particularly true of coiled rod which is, in operation subject to cyclic stressing and great efforts must be made to avoid damaging the surface of the rod which could create stress risers and premature failure of the coilable product.

Coiled tubing as it is now used in some conventional coiled tubing injectors is regularly damaged and this can be observed on the coilable tubing product itself. The selection of the materials and their design and use must be carefully done so as to minimize the damage to the coiled tubing and the present invention makes it possible to use elements which will create little or no damage to the surface of the tube as compared to the present practices in handling coiled tubing.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A well string injector, comprising:

a frame having a longitudinal axis, and first and second frame ends;

a support structure at the second frame end for supporting the frame such that well string may be directed towards a target;

a guide at the first frame end for guiding well string along the frame;

a first clamp mounted on the frame, the first clamp comprising first and second clamping members;

a second clamp mounted on the frame longitudinally spaced from the first clamp, the second clamp comprising third and fourth clamping members;

at least one of the first and second clamps being movable on the frame in relation to the other in the longitudinal direction; and at least the first clamp being oriented on the frame to provide clamping forces on well string by movement of the first and second clamping members predominantly in a transverse direction perpendicular to the frame longitudinal direction.

2. The well string injector of claim 1 in which the first clamp further comprises:

a first well string gripping die carried by the first clamping member;

the second clamping member being mounted on the first clamping member for transverse motion in relation to the frame; and a second well string gripping die carried by the second clamping member and mounted in a position opposed to the first well string gripping die for gripping well string.

3. The well string injector of claim 2 in which the first clamping member is adjustably secured on the frame for limited transverse motion.

4. The well string injector of claim 2 in which:

the first clamping member comprises a cylinder mounted transversely on the frame, the cylinder having a closed end and an open end;

the second clamping member comprises a piston mounted in the open end of the cylinder and first and second arms extending from one of the piston and the cylinder on either side of the cylinder beyond the first well string gripping die; and the second well string gripping die being mounted between the first and second arms.

5. The well string injector of claim 4 in which the first well string gripping die is mounted at the closed end of the cylinder.

6. The well string injector of claim 4 in which the first clamping member is adjustably secured on the frame for limited transverse motion to grip different sizes and shapes of well string.

7. The well string injector of claim 2 further including a third well string gripping die carried by the first clamp for location between parallel spaced well string clamped by the first clamp.

8. The well string injector of claim 1 in which at least one of the first and second clamps comprises:

a first well string gripping die carried by the first clamping member;

a second well string gripping die carried by the second clamping member in a position opposed to the first well string gripping die for gripping well string;

the first and second clamping members being pivotally mounted with respect to each other for movement about a pivot; and a force applicator attached at respective first and second points of attachment to each of the first and second clamping members for applying force to the first and second clamping members.

9. The well string injector of claim 8 further including a third well string gripping die carried by the first clamp for location between parallel spaced well string clamped by the first clamp.

10. The well string injector of claim 8 in which the pivot is between the first and second well string gripping dies and the respective points of attachment of the force applicator to the first and second clamping members.

11. The well string injector of claim 1 in which the first and second well string gripping dies each include a gripping surface that induces an optimized stress distribution in well string clamped by the gripping dies when the well string is in tension.

12. The well string injector of claim 11 in which one or both of the first and second well string gripping dies comprise a barrier wall for preventing walk out of well string.

13. The well string injector of claim 1 in which the first and second clamps each comprise:

a first well string gripping die mounted on a translational force applicator; and a second well string gripping die mounted on the translational force applicator.

14. The well string injector of claim 13 further including a third well string gripping die carried by the first clamp for location between parallel spaced well string clamped by the first clamp.

15. The well string injector of claim 13 in which the translational force applicator comprises a piston and cylinder.

16. The well string injector of claim 13 in which one or both of the first and second well string gripping dies comprise a barrier wall for preventing walk out of well string.

17. The well string injector of claim 1 in which the first and second clamping members are hydraulically actuated by a hydraulic cylinder mounted between them.

18. The well string injector of claim 17 in which the third and fourth clamping members are hydraulically actuated by a hydraulic cylinder mounted between them.

19. A well string injector, comprising:

a frame having a longitudinal axis, and first and second frame ends;

support means at the second frame end for supporting the frame such that well string may be directed towards a target;

guide means at the first frame end for guiding well string along the frame;

a first clamp mounted on the frame;

the first clamp comprising first and second clamping members, the first and second clamping members respectively carrying first and second well string gripping dies, the first and second well string gripping dies each having a well string gripping surface, and the second well string gripping die being mounted in a position opposed to the first well string gripping die for gripping well string;

a second clamp mounted on the frame longitudinally spaced from the first clamp;

the second clamp comprising third and fourth clamping members, the third and fourth clamping members respectively carrying third and fourth well string gripping dies, the third and fourth well string gripping dies each having a well string gripping surface, and the fourth well string gripping die being mounted in a position opposed to the third well string gripping die for gripping well string;

the first and second clamps being movable on the frame in relation to each other in the longitudinal direction; and each of the first clamp and the second clamp being oriented on the frame to provide clamping forces on well string by translational movement of the respective first and second clamping members and the third and fourth clamping members in a predominantly transverse direction perpendicular to the frame longitudinal direction.

20. The well string injector of claim 19 further including a third well string gripping die carried by the first clamp for location between parallel spaced well string clamped by the first clamp.

21. The well string injector of claim 19 in which:

the first clamping member comprises a cylinder mounted transversely on the frame, the cylinder having a closed end and an open end;

the second clamping member comprises a piston mounted in the open end of the cylinder and first and second arms extending from one of the piston and the cylinder on either side of the cylinder beyond the first well string gripping die; and the second well string gripping die being mounted between the first and second arms.

22. The apparatus of claim 21 in which the first well string gripping die is mounted on the closed end of the cylinder.

23. The well string injector of claim 19 in which the first and third clamping members are pivotally secured at first and second pivots to the second and fourth clamping members respectively; and each of the first and second clamps further comprises:

a force applicator attached at respective first and second points of attachment to the clamping members for applying force to the clamping members.

24. The well string injector of claim 20 in which the pivots of each clamp are between the well string gripping dies and the respective points of attachment of the force applicator to the clamping members.

25. The well string injector of claim 19 in which the first and second clamps each comprise:

a first well string gripping die mounted on a translational force applicator; and a second well string gripping die mounted on the translational force applicator.

26. The well string injector of claim 25 further including a third well string gripping die carried by the first clamp for location between parallel spaced well string clamped by the first clamp.

27. The well string injector of claim 25 in which the translational force applicator comprises a piston and cylinder.

28. The well string injector of claim 20 in which one or both of the first and second well string gripping dies comprise a barrier wall for preventing walk out of well string.

29. The well string injector of claim 19 in which the first and second clamping members are hydraulically actuated by a hydraulic cylinder mounted between them.

30. The well string injector of claim 29 in which the third and fourth clamping members are hydraulically actuated by a hydraulic cylinder mounted between them.

* * * * *